US006111240A

United States Patent [19]

Kishimoto et al.

[11] Patent Number: 6,111,240

[45] Date of Patent: Aug. 29, 2000

[54] ELECTRIC APPLIANCE

[75] Inventors: Masamitsu Kishimoto, Matsubara; Yoshihiro Aramaki, Nara; Susumu Hamada, Takatsuki; Tetsuichi Arita, Kawachinagano; Yasuo Shin, Nara; Sakae Kondou, Kashiwara, all of Japan

[73] Assignee: Sharp Kabushiki Kaisha, Osaka, Japan

[21] Appl. No.: 09/121,049

[22] Filed: Jul. 23, 1998

[30] Foreign Application Priority Data

| | | | |
|---|---|---|---|
| Aug. 14, 1997 | [JP] | Japan | 9-219405 |
| Jan. 22, 1998 | [JP] | Japan | 10-010703 |
| Mar. 31, 1998 | [JP] | Japan | 10-085951 |

[51] Int. Cl.[7] ..... H05B 6/68

[52] U.S. Cl. ..... 219/720; 219/702; 219/719; 200/336

[58] Field of Search ..... 200/336, 564, 200/317; 219/702, 719, 720, 506

[56] References Cited

U.S. PATENT DOCUMENTS

| | | | |
|---|---|---|---|
| 4,430,540 | 2/1984 | Scalf | 219/10.55 B |
| 5,349,164 | 9/1994 | Ohta | 219/506 |
| 5,373,142 | 12/1994 | Ohshima et al. | 219/506 |
| 5,607,611 | 3/1997 | Lee | 219/702 |
| 5,728,997 | 3/1998 | Kim et al. | 219/702 |

FOREIGN PATENT DOCUMENTS

| | | |
|---|---|---|
| 61-99235 | 5/1986 | Japan . |
| 62-130304 | 8/1987 | Japan . |
| 164836 | 4/1989 | Japan . |
| 367925 | 3/1991 | Japan . |
| 688618 | 3/1994 | Japan . |
| 7119985 | 5/1995 | Japan . |

*Primary Examiner*—Teresa Walberg
*Assistant Examiner*—Shawntina Fuqua

[57] ABSTRACT

An electric appliance has a timer for calculating the remaining time, an operation member operated by being rotated, an adjuster for adjusting the remaining time, and a display for displaying the remaining time. When the operation member is operated while the timer is counting time, the adjuster adjusts the remaining time, and the display displays the adjusted remaining time.

15 Claims, 17 Drawing Sheets

ELECTRIC APPLIANCE

BACKGROUND OF THE INVENTION

1. Field of the Invention

The present invention relates to an electric appliance, and particularly to an electric appliance provided with a time setting means having a simple structure for setting operation time.

2. Description of the Prior Art

An electric appliance such as a microwave oven, electric clothes washer, electric clothes drier, or dishwasher is provided with a time setting device for setting the duration of its operation. FIGS. 1 and 2 show one well-known example of such a time setting device as is used in a microwave oven exemplifying such an electric appliance. This microwave oven employs a microcomputer to control a timer, and its operation time, i.e. the duration of its operation as set by the timer, is entered by the use of a rotary encoder, for example. This type of microwave oven has an operation panel 2 as shown in FIG. 1. The operation panel 2 has, in its upper portion, a display 4 and, in its lower portion, a knob 6 that is operated to rotate a rotary encoder 5 (FIG. 2). In addition, between the display 4 and the knob 6 are provided a start switch 8 and a cancel switch 10. The display 4 is composed of a liquid crystal display device or a fluorescent display device, and serves to display a figure (a value) indicating the operation time (timer-set duration) that is entered by rotating the knob 6 in the direction indicated by an arrow 12.

This microwave oven, which has the operation panel 2 as shown in FIG. 1, is controlled by a control system as shown in FIG. 2. The microwave oven has a magnetron 14 for heating food, a lamp 16 for illuminating the heating chamber, and a fan 18 for cooling the magnetron 14, and these components are controlled by a door switch 20 and a relay switch 22. The relay switch 22 is opened and closed by a controller 24, which receives signals from the start switch 8, the cancel switch 10, and the rotary encoder 5. In relation to the controller 24, a timer 26 is provided.

In this microwave oven, when the knob 6 of the rotary encoder 5 is operated, the operation time, i.e. the duration for which the food is heated, is set according to the angle through which the knob is rotated, and then the operation time thus set is displayed on the display 4. After the operation time is set in this way, a press of the start switch 8 causes the controller 24 to close the relay switch 22. At this time, if the door of the heating chamber is closed, i.e. if the door switch 20 is closed, the magnetron 14 starts oscillating and thereby heating the food in the heating chamber. Simultaneously, the lamp 16 is turned on, and the cooling fan 18 is turned on to cool the magnetron 14. At the same time that the magnetron 14 starts heating, the timer 26 is activated. The timer 26 counts down from the previously set operation time, and the time recognized by the timer 26 as remaining, i.e. the duration for which the heating is still to be continued, is displayed on the display 4. When the timer 26 completes counting the previously set operation time and recognizes that there is no (zero) remaining time, the controller 24 opens the relay switch 22, and turns off the magnetron 14, the lamp 16, and the cooling fan 18.

A press of the cancel switch 10 allows the heating to be stopped at any time. When the cancel switch 10 is pressed, the controller 4 produces a cancellation signal, by the use of which it opens the relay switch 22 and thereby stops the heating that was started as described above. The cancellation signal is fed also to the display 4 to reset to zero the figure displayed thereon.

Such control of an microwave oven provided with a time setting device is disclosed, for example, in Japanese Laid-Open Patent Applications Nos. H 7-190377, H 7-332684, and H 6-241466.

FIGS. 3 and 4 show another well-known example of a time setting device 30, employing light-emitting devices (LEDs), as is used in an electric washer exemplifying another electric appliance provided with a time setting device (according to Japanese Laid-Open Utility Model No. H 1-64836). The time setting device 30 of this washer is provided with a rotary switch having a knob 32 that is rotated to operate the rotary switch, and a time indication panel 35 placed around the knob 32. The time indication panel 35 has markings of figures to indicate the operation time that is currently set. The rotary switch produces a signal containing as many pulses as corresponds to the angle through which the knob 32 is rotated. The washer further has a controller (not shown) for controlling the washer proper, and a timer (not shown) for counting time. The timer counts down from the operation time that is set by the time setting device. The controller controls a series of indicators according to the angle through which the knob 32 is rotated and according to the time recognized by the timer as remaining.

As shown in FIGS. 4A and 4B, in this washer, as the knob 32 is rotated, the controller turns on one of a series of indicators 34 after another so that as many of them as corresponds to the angle through which the knob 32 is rotated are lit simultaneously. Thus, out of the figures marked in the time indication panel 35, that one which is marked at the indicator which is lit last indicates the time that is eventually set.

On the other hand, in another example of a microwave oven shown in FIG. 5, the microwave oven 41 has a door 42 for opening and closing a heating chamber 43 and, on the right thereof, an operation panel 45 for making settings and others. On the operation panel 45 are arranged a time setting knob 49 for setting the cooking time, a power setting knob 53 for setting the heating power, an open/close button for opening and closing the door 41, and others.

The time setting knob 49 has a structure as disclosed, for example, in Japanese Laid-Open Patent Application H 7-119985 and as illustrated in a sectional view shown in FIG. 6. The time setting knob 49 has a boss 49*a* having a boss hole 49*b*. A time setting device 47, such as a rotary encoder, is fixed to a control circuit board 46, and its rotary shaft 47*a* is pressed into the boss hole 49*b* through a through hole 45*a* formed in the operation panel 45. The time setting device 47 is fixed, with screws 60, to bosses 59 formed on the back surface of the operation panel 45, with a watertight plate 58 between them.

On the front surface of the operation panel 45, a rib 48 (hereafter also referred to as the "watertight rib") is provided that protrudes so as to encircle the through hole 45*a*. During cleaning of the operation panel 45 by the use of wet wiping cloth or the like, this watertight rib 48 serves to stop the water that penetrates through the gap a1 between the time setting knob 49 and the operation panel 45 and make it flow around the rib 48 and drop through the gap a2 between the time setting knob 49 and the operation panel 45. In case water drops penetrate inside the operation panel 45, they are discharged by being guided along the watertight plate 58 and then from a ramp 58*a* formed in it toward the back surface of the operation panel 45.

In the microwave oven described previously, when the knob 6 is rotated, the heating time is set according to the angle through which the knob 6 is rotated, and the thus set heating time is displayed on the display 4. Thereafter, a press of the start switch 8 causes the controller 24 to turn on the relay switch 22 and thereby start heating. The heating is achieved by heating the food put in the heating chamber by the action of microwaves generated through the oscillation of the magnetron 14. Meanwhile, the lamp 16 is lit to illuminate the food being heated so that its condition is visible through the sightglass provided in the door, and a fan motor 18 is rotated to cool the magnetron 14 and a high-voltage transformer 227. In addition, at the same time that the heating is started, the timer 26 is activated so that it thereafter continues counting down from the previously set heating time and displaying the remaining time on the display 4. When the remaining time becomes zero, the relay switch 22 is turned off to stop the heating. Otherwise, the heating can be stopped also by opening the door during heating, in which case the door switch 20 is turned off and the heating is only suspended for a while, or by pressing the cancel switch 10 during heating, in which case the controller 24 turns off the relay switch 22 and thereby stops the heating completely, simultaneously resetting to zero the remaining time of the timer 35 as well as the figure displayed on the display 4.

The well-known electric appliances described above, however, have various disadvantages. For example, in the microwave oven shown in FIGS. 1 and 2, it is practically impossible to change, i.e. increase or decrease, the operation time during heating once it is set by the operation of the rotary encoder 5. That is, to change the operation time, it is necessary to first press the cancel switch 10 to cancel the already set operation time and then operate the rotary encoder 5 again to set a new operation time. Thus, the operation for changing the operation time is rather complicated, and requires an extra component, i.e. the cancel switch 10, for canceling the previously set operation time. This complicates the structure and control of the microwave oven. Moreover, since the knob 6 of the rotary switch and the display 4 for displaying the currently set operation time are placed apart from each other, the operator is obliged to operate the knob 6 while watching the display 4, and therefore this knob 6 is far from user-friendly. Furthermore, since a liquid crystal display device, fluorescent display device, or the like is employed as the display 4, it is inevitable that the microwave oven as a whole is rather expensive.

In addition, the time setting device as used in the microwave oven shown in FIG. 1 employs as its display 4 a liquid crystal display device or fluorescent display device and thus demands high production cost. Such a time setting device is too expensive to be used, for example, in a budget-priced microwave oven that is designed to offer only basic functions and therefore in which the display is expected simply to display the heating time.

On the other hand, in the washer shown in FIG. 3, it is necessary to arrange a series of indicators 34 around the knob 32, and provide a time indication panel 35 further out. This not only leads to a dull layout of the operation panel, for example, in a budget-priced microwave oven that has an operation panel provided only with a heating time setting device, a start switch, and a cancel switch, but also causes the operation panel to occupy an unduly large area and thereby makes the appearance of the microwave oven unappealing.

In the washer shown in FIGS. 3 and 4, it is practically impossible to change, i.e. increase or decrease, the operation time during operation once it is set by the operation of the rotary switch. In addition, in the time setting device 30, the time indication panel 35 is provided separately from the series of indicators 34, and therefore, in dark surroundings, even through it is possible to recognize which of the indicator 34 are lit, it is not easy to recognize the remaining time of the timer.

In the microwave oven shown in FIGS. 5 and 6, in case water drops penetrate inside the watertight rib 48, they flow down along the inner surface of the watertight rib 48 and collect in the lower portion of the watertight rib 48. This promotes the growth of mold. Moreover, although the time setting device 47 can be fixed in position simply by fixing the control circuit board 46 directly to the bosses 59, it is necessary to additionally provide the watertight plate 58 simply to protect electronic components such as the control circuit board from water penetrating inside the operation panel 45. This demands extra cost. Furthermore, although the rotary shaft 47*a* of the time setting device 47 is pressed into the boss hole 49*b* of the time setting knob 49, it is still possible to pull out the time setting knob 49 by pulling it with a sufficiently strong force. In such a case, a foreign object may enter through the through hole 45*a* and, by coming into contact with the control circuit board or other component, cause a malfunction of the microwave oven.

In cases where the heating power needs to be adjusted in steps, it is necessary to use a click mechanism. However, a cooking condition setting device having such a click mechanism is expensive, and therefore using it in place of the time setting device 47 shown in FIG. 6 has been demanding high extra cost.

SUMMARY OF THE INVENTION

An object of the present invention is to provide an electric appliance in which the time recognized by a timer means as remaining can be adjusted even after the timer means has already started its counting operation and the thus adjusted remaining time is reflected in the display of the remaining time.

Another object of the present invention is to provide an electric appliance in which improved resistance to mold and water is achieved in a simple structure.

Another object of the present invention is to provide an electric appliance in which the area occupied by an operation panel is minimized to make the appearance of the appliance more appealing.

To achieve the above objects, according to one aspect of the present invention, an electric appliance is provided with: an electric appliance proper; an operation member that is operated by being rotated and of which the angle of rotation is correlated with length of time; a setting means for setting the operation time of the electric appliance proper in accordance with the angle of rotation of the operation member; a timer means that starts counting time in response to a predetermined signal to calculate the remaining time for which the electric appliance proper is still to continue operating; a control means for controlling the operation of the electric appliance proper so that the electric appliance proper continues operating until the remaining time runs out; an adjustment means that, when the operation member is operated while the timer means is counting time, adjusts the remaining time in accordance with the angle through which the operation member is rotated; and a display means having a plurality of figures marked around the operation member to indicate various lengths of time corresponding to various angles of rotation of the operation member, and having an illumination member for illuminating those figures individually, the display means displaying the remaining time by illuminating that one of the figures which corresponds to the remaining time.

In this structure, when the operation member is operated while the timer means is counting time, the display means displays the remaining time by causing the illumination member to illuminate the figure corresponding to the remaining time as adjusted by the adjustment means. As a result, the remaining time can be recognized with ease even when the electric appliance is used in dark surroundings.

According to another aspect of the present invention, an electric appliance is provided with: a vertically fitted panel having a through hole and a tubular rib formed around the through hole so as to protrude forward; an operation member fitted on the back side of the panel and having an operation shaft that protrudes forward; and an operation knob having a joint at its back so as to be joined to the operation shaft through the through hole and having such a shape as to cover a part of the surface of the panel on which the rib is formed. In this electric appliance, the rib has a cut formed in its lower portion.

In this structure, water drops that have penetrated into the gap between the operation knob and the panel can be drained by directing them downward along the outer wall of the rib. Even in case water drops penetrate inside the watertight rib, they can be drained by directing them downward along the inner wall of the rib and then out through the cut. This helps prevent the growth of mold resulting from water drops collected inside the rib.

According to another aspect of the present invention, an electric appliance is provided with: a timer for measuring time; a control means for ending the operation of the electric appliance when the time measured by the timer reaches a variable predetermined time; a rotary operation member that is operated by being rotated; a setting means for setting the predetermined time in accordance with an angle through which the rotary operation member is operated; and a display means having a plurality of dot indicators for indicating the predetermined time by turning on some of the dot indicators and turning off the others. In this electric appliance, the rotary operation member and the plurality of dot indicators are arranged in a straight line.

This structure allows the operation panel of the electric appliance to be accommodated compactly, for example, in an oblong area. This helps minimize the area occupied by the operation panel and thus make the appearance of the appliance more appealing.

BRIEF DESCRIPTION OF THE DRAWINGS

This and other objects and features of the present invention will become clear from the following description, taken in conjunction with the preferred embodiments with reference to the accompanied drawings in which.

DESCRIPTION OF THE PREFERRED EMBODIMENTS

Hereinafter, embodiments of the present invention will be described with reference to the drawings.

<First Embodiment>

Figure 7:
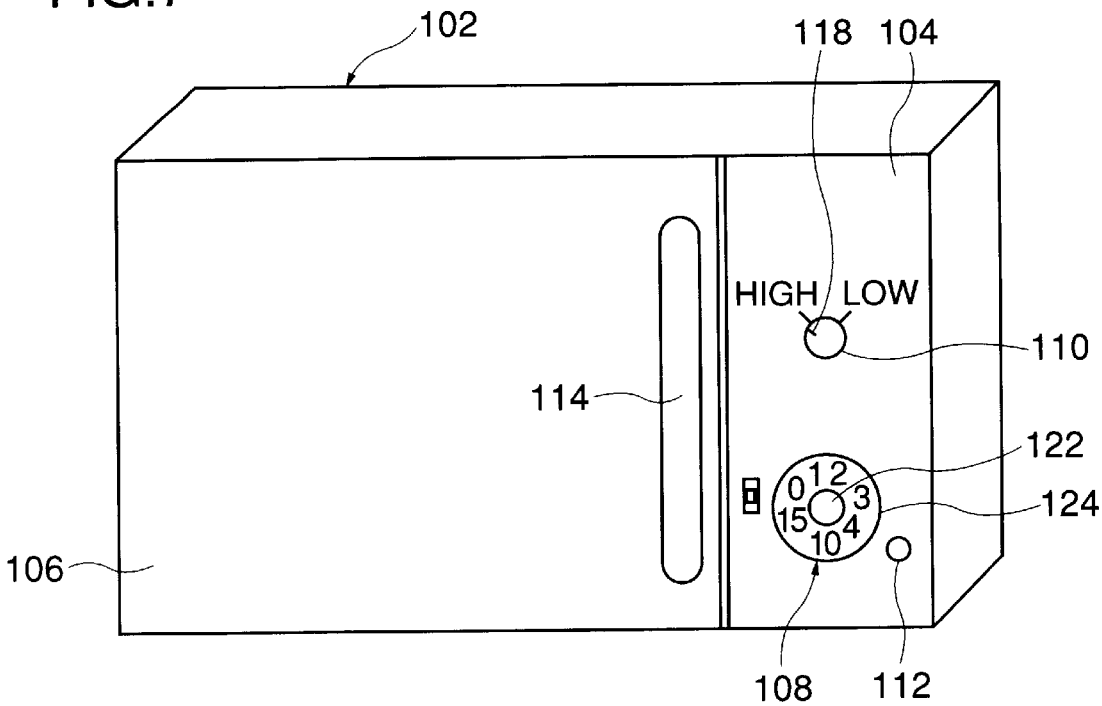
FIG. 7 is a perspective view of the microwave oven of a first embodiment of the present invention.

First, with reference to FIGS. 7 to 12, the structure of an electric appliance of a first embodiment of the present invention will be described. Here, a microwave oven is taken up as an example of such an electric appliance. FIG. 7 is a perspective view of the microwave oven, FIG. 8 is a sectional view illustrating the time setting device used in the microwave oven and the portion around it, and FIG. 9 is a diagram illustrating the rotary operation member of the time setting device and the portion around it.

Referring mainly to FIG. 7, a description will be given below of the first embodiment. The microwave oven shown there has a microwave oven proper 102 (constituting the electric appliance proper) in the shape of a rectangular parallelepiped. On the front surface of the microwave oven proper 102 are provided an operation panel 104 and an open/close door 106. The operation panel 104 is provided at the right-hand end of the front surface. In this embodiment, this operation panel 104 is provided with a time setting device 108, a power setting switch 110, and a repeat switch 112. The door 106 is rotatably fitted to the microwave oven proper 102. Inside the microwave oven proper 102, a heating chamber (not shown) for accommodating food to be cooked or frozen food to be defrosted is secured. When the door 106 is closed as shown in FIG. 7, it keeps the heating chamber shut at its front-surface side, so that it is possible, through appropriate operation as described later, to heat the food or defrost the frozen food. On the other hand, when the door 106 is open, it keeps the heating chamber at its at its front-surface side, so that it is possible to put to be defrosted into the heating chamber, or to take heated food or defrosted frozen food out of the heating chamber. The door 106 is, at one end, provided with a grip 114 with which it is opened and closed.

The power setting switch 110 is used to switch the power of the microwave output of the magnetron 116 (FIG. 11) described later, and is fitted oil the operation panel 104 so as to be rotatable between a first angle position and a second angle position as shown in FIG. 7. When the power setting switch 110 is rotated counter-clockwise so that the arrow 118 engraved thereon points to the label "high" marked on the front surface of the operation panel 104, it is brought into the above-mentioned first angle position, causing the magnetron 116 operate at a high power. By contrast, when the power setting switch 110 is rotated clockwise so that the arrow 118 engraved thereon points to the label "low" marked on the front surface of the operation panel 104, it is brought into the above-mentioned second angle position, causing the magnetron 116 to operate at a low power.

Figure 8:
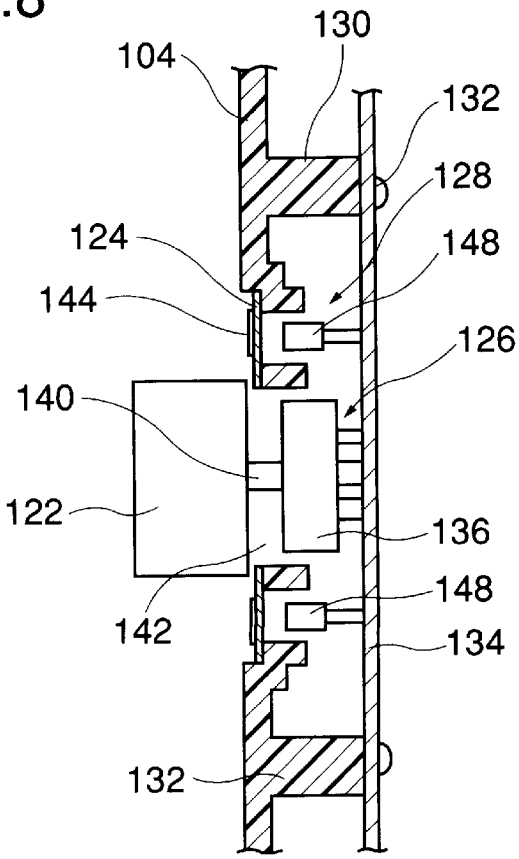
FIG. 8 is a sectional view of the time setting device, together with the portion around it, of the microwave oven shown in FIG. 7.
Figure 9:
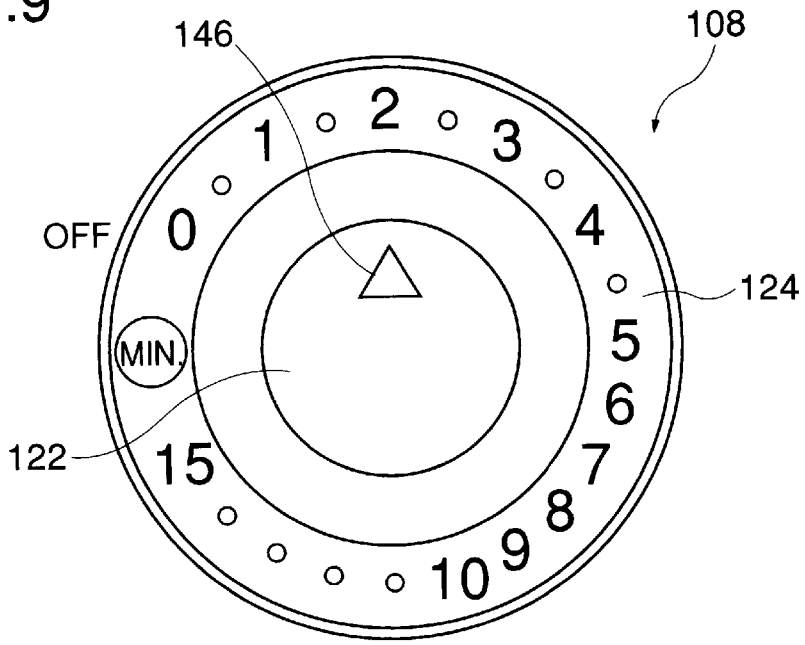
FIG. 9 is a front view of the rotary operation member, together with the time indication panel provided around it, of the time setting device shown in FIG. 8.

Referring to FIGS. 8 and 9, the time setting device 108 shown there is provided with a rotary operation member 122 having the shape of a short cylinder, a time indication plate 124 placed around this rotary operation member 122, and a time signal generator 126 that generates a signal indicating the time to be set in accordance with the angle through which the rotary operation member 122 is rotated. In relation to the time indication plate 124, a remaining time indicator 128 is provided. In this embodiment, on the back surface of the operation panel 104, a plurality of supporting projections 130 (of which two are shown in FIG. 8) are provided so as to project rearward. On the rear-end surfaces of these supporting projections 130, a circuit board 134 is fitted with screws 132. In a predetermined position on this circuit board 134, a variable resistor 136 constituting the time signal generator 126 is provided. This variable resistor 136 serves as a potentiometer 138 (FIG. 11) whose resistance varies with the angle through which the rotary operation member 122 is rotated. The variable resistor 136 has a shaft 140, and is placed with the tip of the shaft 140 sticking out of a circular opening 142 formed in the lower portion of the operation panel 104. The rotary operation member 122 is fitted at the tip of this shaft 142.

The time indication plate 124 is placed around the opening 142 of the operation panel 104. The time indication plate 124 shown in the figures is made of transparent film, and is bonded onto the front surface of the operation panel 104, for example, with adhesive. On its front surface, this time indication plate 124 has figures, time subdivision symbols, and unit time symbols marked at predetermined intervals along its circumference in fluorescent paint 144. As shown in FIG. 9, in this embodiment, the markings start with an indication of the unit "min.", which is followed by consecutive figures from "0" to "10", with a time subdivision symbol "○" placed between every two adjacent figures from "0" to "5" to indicate a subdivision of the unit time (in this embodiment, 1 minute). This is because more precise time setting is desired in cooking or defrosting that requires a heating time shorter than 5 minutes. As the time subdivision symbol, it is of course possible to use a symbol other than "○", such as "※", "☆", or "▽". In this case, a time subdivision symbol represents half a minute, i.e. 30 seconds. Accordingly, with this setting device 108, it is possible to set the heating time in 30-second increments for heating times up to 5 minutes. The figure "10" is followed by a figure "15", with four unit time symbols "○" similar to the time subdivision symbol arranged substantially at regular intervals between them. Thus, with this time setting device 108, it is possible to set the heating time at 15 minutes at the maximum. For heating times from 10 to 15 minutes, it is possible to set the heating time in 1-minute increments, though, in this range, such increments are not indicated by individual figures but by unit time symbols "○". The rotary operation member 122 has a triangular mark 146 on its front surface so that the mark 146 points to the figure or the time subdivision symbol on the time indication plate 124 that represents and indicates the heating time that is actually set.

How the time setting device 108 sets the operation time depends on the type of the microwave oven. For example, the maximum operation time does not necessarily have to be 15 minutes, but may be 20 minutes, 30 minutes, or any other length of time. The range of the operation time in which it can be set in 30-second increments does not necessarily have to be up to 5 minutes, but may be up to 10 minutes, 15 minutes, or any other length of time. Time subdivision does not necessarily have to be every 30 seconds, but may be every 20 seconds, 15 seconds, or any other length of time. It is also possible to indicate all the multiples of the unit time with figures.

The remaining time indicator 128 is provided with a plurality of light-emitting devices 148 that are placed in relation to the time indication plate 124. The light-emitting devices 148 are each composed of, for example, a light-emitting diode, and are placed one for each of the figures, time division symbols, and unit time symbols on the time indication plate 124. The light-emitting devices 148 are mounted on the circuit board 134, and their light-emitting portions are placed inside the corresponding ones of the figures, time subdivision symbols, and unit time symbols on the time indication plate 124. These light-emitting devices 148, by illuminating the operation panel 104 from the back, clearly display the corresponding figures and symbols. In this embodiment, as described above, the figures, time subdivision symbols, and unit time symbols are marked in fluorescent paint, and this helps increase the clearness with which those figures and symbols are displayed by being illuminated by the light-emitting devices 148 and thus increase their readability. It is also possible to mark figures and symbols by, instead of directly marking them in fluorescent paint, applying fluorescent paint around them.

Figure 11:
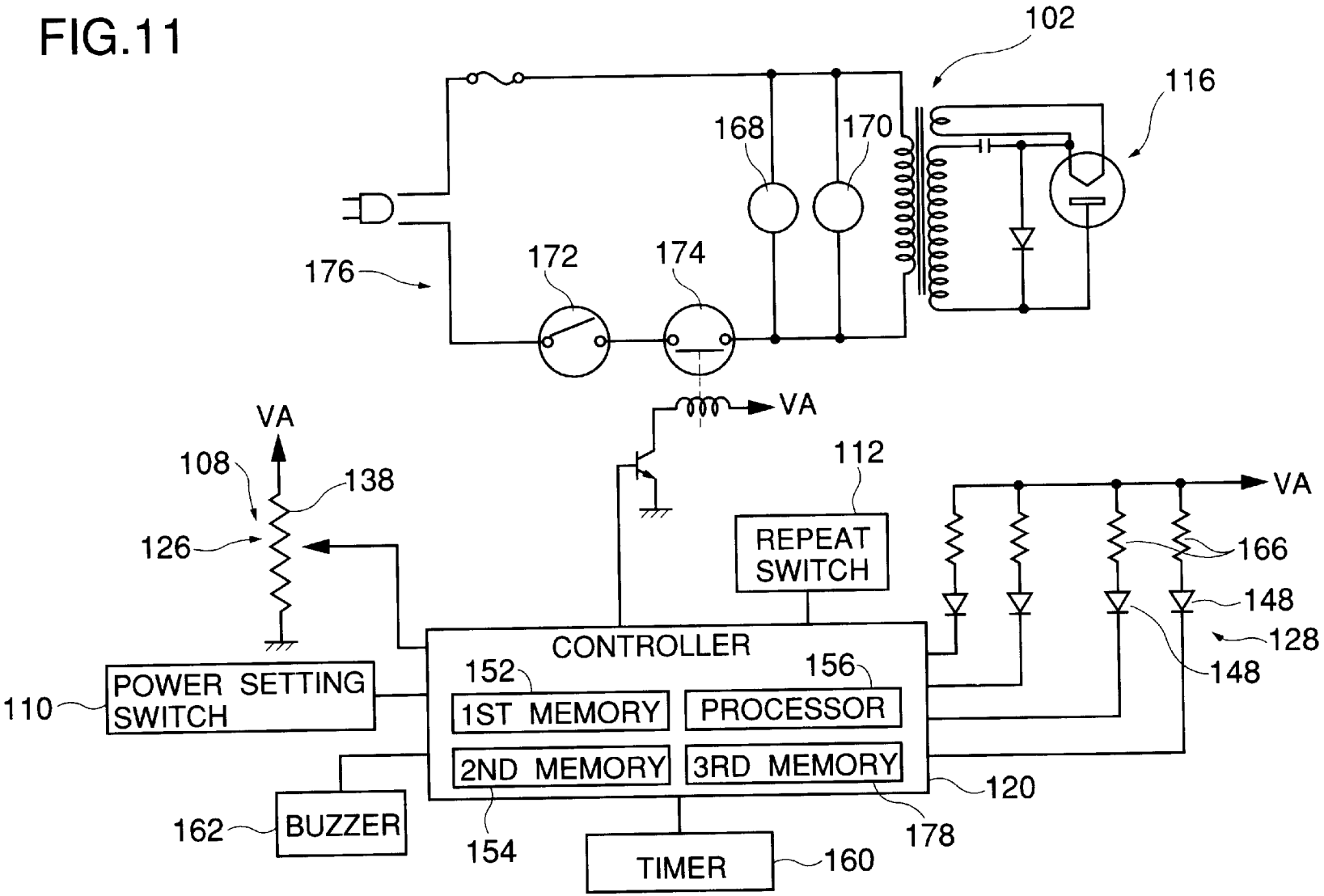
FIG. 11 is a block circuit diagram of the control system of the microwave oven shown in FIG. 7.

In this embodiment, the microwave oven is controlled by a control system as shown in FIG. 11. During this control, the variable resistor 136 generates a time setting signal in accordance with the angle through which the rotary operation member 122 is rotated. Referring mainly to FIG. 11, in this embodiment, the controller 120 is composed of, for example, a microcomputer, and includes a first memory 152, a second memory 154, and a processor 156. In relation to this controller 120, a timer 160 is provided. The first memory 152 stores the operation time set by the time setting device 108, and the second memory 154 stores the time recognized by the timer 160 as remaining. The timer 160 starts counting time immediately when the operation time is set by the time setting device 108. The processor 156 on the one hand calculates the remaining time of the timer 160, and on the other hand determines how the operation time is changed when the rotary operation member 122 is rotated while the timer 160 is operating.

In relation to the controller 120, a buzzer 162 and a repeat switch 112 (see also FIG. 7) are also provided. The buzzer 162 is activated when the remaining time of the timer 160 becomes zero in order to sound a beep and thereby let the operator know of the completion of heating by the microwave oven. The repeat switch 112 is used when heating is repeated with the same heating time set by the time setting device 108. This helps eliminate the need to operate the rotary operation member 122 again when heating is repeated with the same heating time as previously set. The power setting signal from the power setting switch 110 and the time setting signal from the time signal generator 126 are fed to the controller 120. The remaining time indicator 128 has a plurality of light-emitting devices 148 that are, at one end, connected to the controller 120 and, at the other end, connected individually to resistors 166.

The microwave oven proper 102 has, in addition to the magnetron 116, an illumination lamp 168 and a cooling fan 170. The magnetron 116, the illumination lamp 168, and the cooling fan 170 are controlled by an electric circuit 176 provided with a door switch 172 and a relay switch 174. The magnetron 116 oscillates and thereby heats the food or frozen food put in the heating chamber. The illumination lamp 168 is turned on to illuminate the inside of the heating chamber, and the cooling fan is turned on to cool the magnetron 116. The door switch 172 is provided in relation to the door 106 (FIG. 7): when the door 106 is closed, the door switch 172 is closed (oil), and when the door 106 is open, the door switch 172 is open (off), deactivating the magnetron 116 and others. The relay switch 174 is controlled by the controller 120 so that it is closed (on) when the magnetron 116 is in the process of heating and is open (off) on completion of heating.

In this embodiment, the heating power of the magnetron 116 is controlled in the following manner. When the power setting switch 110 is set in the "high" position, a signal requesting high-power output is fed from the power setting switch 110 to the controller 120, which then instructs the magnetron 116 and others to operate at high power. Specifically, when high-power output is selected, the controller 120 keeps the relay switch 174 closed all the time while the timer 160 is active. Accordingly, the magnetron 116 keeps operating and thereby heating the food in the heating chamber until the remaining time of the timer 160 becomes zero. High-power output is used, for example, to prepare boiled rice and side dishes that are supposed to be warm. By contrast, when the power setting switch 110 is set in the "low" position, a signal requesting low-power output is fed from the power setting switch 110 to the controller 120, which then instructs the magnetron 116 and others to operate at low power. Specifically, when low-power output is selected, the controller 120 keeps the relay switch 174 closed for 50%, for example, of the period in which the timer 160 is active. For example, the controller 120 first keeps the relay switch 174 closed for 24 seconds at the beginning of operation to energize the magnetron 116, and it then keeps the relay switch 174 open for 24 seconds. The controller 120 repeats this pattern so that the magnetron 116 will eventually be energized for half the previously set operation time and thus the average output of the magnetron 116 is reduced to approximately half its normal output. Low-power output is used, for example, to defrost frozen food. The proportion of the operation time for low-power output to that for full-power output may vary with the type of the microwave oven, and the proportion actually used is stored, for example, in a third memory 178 included in the controller 120.

The operation time is set by the use of the rotary operation member 122 typically in the following manner. The variable resistor 136 constituting the time signal generator 126 serves as the potentiometer 138, and is so designed that its resistance decreases as the rotary operation member 122 is rotated through a larger angle. Accordingly, as seen from FIG. 11, when the rotary operation member 122 is rotated through a small angle, the potentiometer 138 exhibits a high resistance, and therefore the input voltage VR to the controller 120 is low. As the rotary operation member 122 is rotated through a greater angle, the potentiometer 138 exhibits a lower resistance, and therefore the input voltage VR to the controller 120 increases. This input voltage VR is used as the time setting signal.

Figure 10:
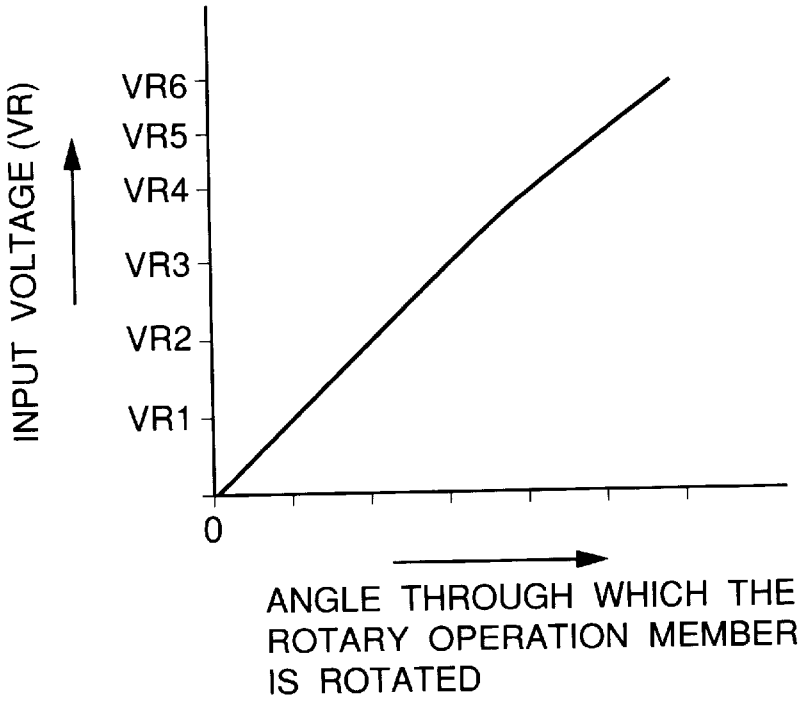
FIG. 10 is a graph showing the relation between the angle through which the operation member is rotated and the input voltage to the controller.

FIG. 10 shows the relation between the angle through which the rotary operation member 122 is rotated and the input voltage R to the controller 120. Thus, the input voltage VR and the operation time set correspondingly, i.e. the duration for which the microwave oven is to perform heating, exhibit correspondence as shown in Table 1.

TABLE 1

| Input Voltage (VR) to the Controller 120 | Operation Time Set |
|---|---|
| $0 < VR \leqq VR1$ | 30 seconds |
| $VR1 < VR \leqq VR2$ | 1 minute |
| $VR2 < VR \leqq VR3$ | 1 minute 30 seconds |
| $VR3 < VR \leqq VR4$ | 2 minutes |
| . | . |
| . | . |
| . | . |
| $VR19 < VR \leqq VR20$ | 15 minutes |

Referring to Table 1, in this embodiment, when the input voltage VR to the controller 120 is such that $0<VR\leqq VR1$, the controller 120 interprets this input voltage as requesting an operation time (heating time) of 30 seconds, and stores this operation time of 30 seconds in the first memory 152. When the input voltage VR to the controller 120 is such that $VR1<VR\leqq VR2$, the controller 120 interprets this input voltage as requesting an operation time (heating time) of 1 minute, and stores this operation time of 1 minute in the first memory 152. Similarly, when the input voltage VR to the controller 120 is such that $VR19<VR\leqq VR20$, the controller 120 interprets this input voltage as requesting the maximum operation time (heating time) of 15 minutes, and stores the maximum operation time in the first memory 152. This relation between the input voltage to the controller 120 and the operation time correspondingly set can be stored, for example, in the third memory in the controller 120. In this embodiment, the variable resistor 136 is so designed that the resistance of the potentiometer 138 decreases as the rotary operation member 122 is rotated through a larger angle.

However, it is also possible to design the variable resistor 136 so that the resistance of the potentiometer 138 increases as the rotary operation member 122 is rotated through a larger angle.

As soon as the operation time is set in this way, it is stored in the second memory 154 as the time recognized by the timer 160 as remaining. As described later, this remaining time of the timer 160 starts to be counted down by the processor 156 at the same time that the timer 160 starts counting time. The remaining time stored in the second memory 154 is kept updated by such counting down. In addition, as described later, when the rotary operation member 122 is operated while the timer 160 is operating, the remaining time stored in the second memory 154 is adjusted in accordance with the angle through which the rotary operation member 122 is rotated, so that the remaining time stored in the second memory 154 reflect adjustments done in this way.

Based on the remaining time of the timer 160 stored in the second memory 154, the remaining time indicator 128 displays the remaining time. In this embodiment, the controller 120 controls the remaining time indicator 128 in such a way that the minimum value of the remaining time is displayed. Specifically, for example, when the remaining time of the tinier 160 is between 5 minutes 59 seconds and just 5 minutes, the controller 120 turns on the light-emitting device 148 corresponding to the figure "5" marked on the time indication plate 124. This causes the figure "5" on the time indication plate 124 to be illuminated, and thereby the remaining time indicator 128 lets the operator know the remaining time is 5 minutes. As the timer 160 continues counting time, when the remaining time of the timer 160 is, for example, between 4 minutes 59 seconds and 4 minutes 30 seconds, the controller 120 turns on the light-emitting device 148 corresponding to the time subdivision symbol "○" between the figures "5" and "4" on the time indication plate 124. This causes this time subdivision symbol "602 " on the time indication plate 124 to be illuminated, and thereby the remaining time indicator 128 lets the operator know that the remaining time is 4 minutes 30 seconds. As the timer 160 further continues counting time, when the remaining time of the timer 160 is, for example, between 4 minutes 29 seconds and just 4 minutes, the controller 120 turns on the light-emitting device 148 corresponding to the figure "4" on the time indication plate 124. This causes the figure "4" on the time indication plate to be illuminated, and thereby the remaining time indicator 128 lets the operator know that the remaining time is 4 minutes. In this way, the remaining time indicator 128 turns on appropriate ones among the figures, unit time symbols, and time subdivision symbols in accordance with the remaining time stored in the second memory 154, and thereby allows the operator to recognize the remaining time with ease.

In this embodiment, the controller 120 indicates different lengths of time by turning on different combinations of the light-emitting devices 148 of the remaining time indicator 128. However, it is also possible to blink those light-emitting devices 148 at regular intervals. In that case, the remaining time indicator 128 blinks the figure, unit time symbol, and time subdivision symbol that correspond to the remaining time, and thereby makes it easier for the operator to recognize the remaining time. When the light-emitting devices 148 are blinked in this way, it is preferable to vary, in accordance with the remaining time, the intervals at which the light-emitting devices 148 are blinked. For example, when the remaining time of the timer 160 is 5 minutes or more, the light-emitting devices 148 are blinked at relatively long intervals of, for example, about 2 seconds; when the remaining time is 1 minute or more but less than 5 minutes, the light-emitting devices 148 are blinked at medium intervals of, for example, about 1 second; when the remaining time is less than 1 minute, the light-emitting devices 148 are blinked at relatively short intervals of, for example, about 0.5 second. By making the light-emitting devices 148 blink at intervals that vary with the remaining time, it is possible to allow the operator to recognize the remaining time of the timer 160 with ease even from a position away from the microwave oven where it is not possible to read the figures, unit time symbols, and time subdivision symbols on the time indication plate 124. How the light-emitting devices 148 are blinked at varying intervals in accordance with the remaining time may depend on the type of the microwave oven.

Figure 12:
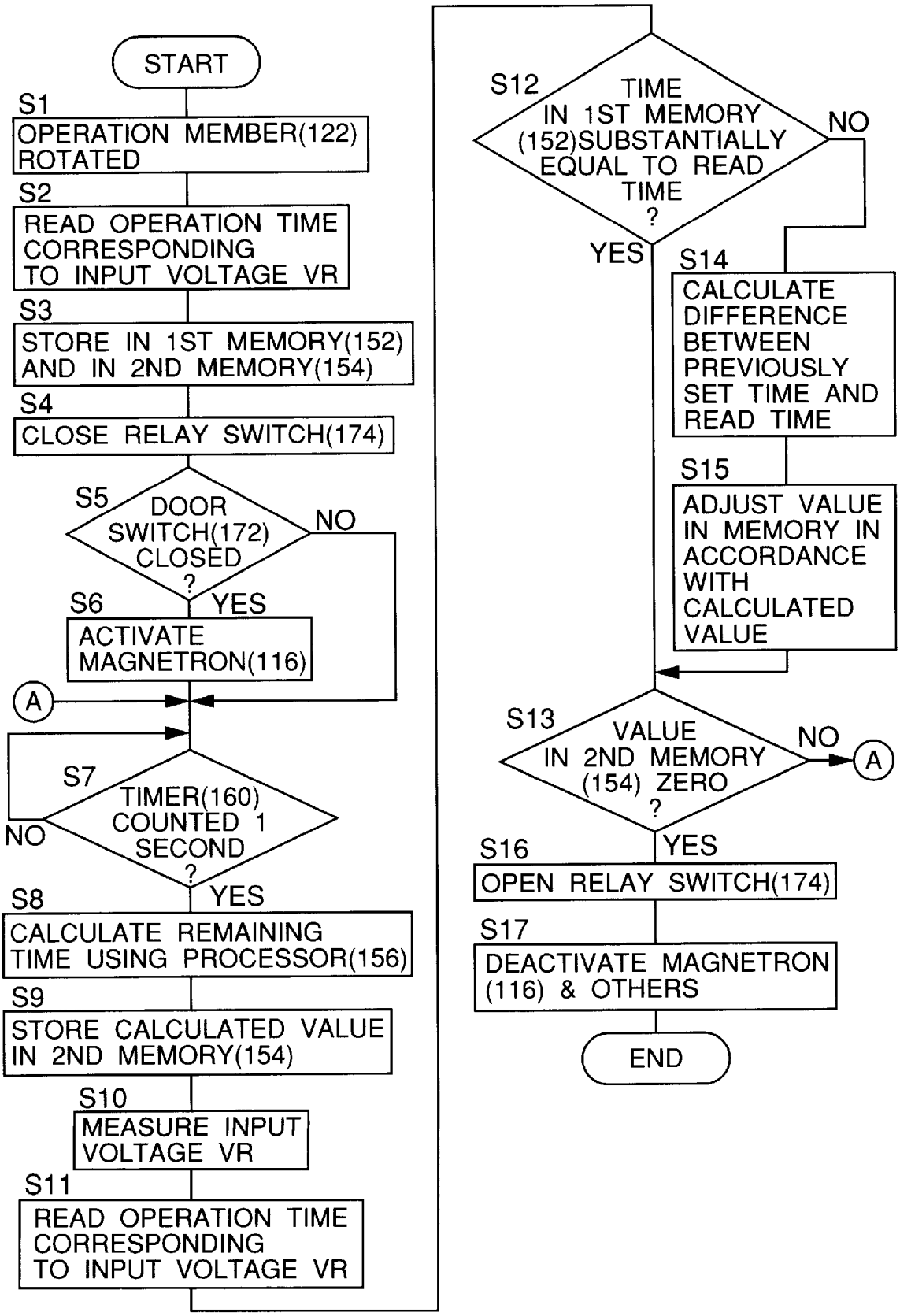
FIG. 12 is a flow chart illustrating the control performed in normal mode in the microwave oven shown in FIG. 7.

The microwave oven described above is controlled according to the flow chart shown in FIG. 12. Referring mainly to FIGS. 11 and 12, to start the operation of the microwave oven, the rotary operation member 122 is operated and thereby the operation time, i.e. the duration for which heating is continued, is set. When the rotary operation member 122 is rotated, the operation sequence proceeds from step S1 to step S2. The controller 120 reads, in the previously described manner, the operation time that is set in accordance with the input voltage VR fed from the variable resistor 136, and then, in step S3, stores the thus read time in the first memory 152 of the controller 120 as the set operation time, and simultaneously stores it also in the second memory 154 as the remaining time of the timer 160.

When the set operation time is stored in the first and second memories 152 and 154 in this way, the operation sequence proceeds to step S4, where the controller 120 closes the relay switch 174 to cause the microwave oven to start heating and simultaneously cause the timer 160 to start counting time. In step S5, whether the door switch 172 is closed or not is checked. If the door switch 172 is closed, that is, if the door 106 is closed, the operation sequence proceeds to step S6, where the magnetron 116, the illumination lamp 168, and the cooling fan 170 are activated to cause the microwave oven to perform heating. By contrast, if the door switch 172 is open, that is, if the door 106 is open, the magnetron 116 and others are not activated, and the operation sequence proceeds from step S5 directly to step S7.

In step S7, whether the timer 116 has counted 1 second or not is checked. If the tinier 116 is found to have counted 1 second, the operation sequence proceeds to step S8, where the processor 156 in the controller 120 decrements the remaining time stored in the second memory 154 by 1 second. Then, in step S9, the remaining time of the timer 160 stored in the second memory 154 is updated with the thus decremented value. In this way, as long as the timer 160 continues counting time, the remaining time is counted down.

In this embodiment, every time the remaining time of the timer 160 is updated, the controller 120 checks weather the operator has rotated the rotary operation member 122 or not. Specifically, first, in step S10, the controller 120 receives the input voltage VR from the variable resistor 136, and then, in step S11, reads the operation time corresponding to this input voltage VR. Then, in step S12, the controller 120 compares the set operation time stored in the first memory 152 with the operation time read in step S11. In this comparison, if the set operation time in the first memory 152 is substantially equal to the operation time read in step S11, this naturally means that the rotary operation member 122 has not been rotated during the heating by the microwave oven. Accordingly, in this case, the operation sequence proceeds to step S13. By contrast, if the set operation time in the first memory 152 differs from the operation time read in step S11, this means that the operator has rotated the rotary operation member 122 during the heating by the microwave oven. Accordingly, in this case, the value stored in the first memory 152 is updated with the operation time read in step S11, and the operation sequence proceeds through steps S14 and S15 to step S13.

When the previously set operation time is adjusted by operating the rotary operation member 122 while the timer 160 is counting time, then, in step S14, the processor 156 calculates the difference between the set operation time in the first memory 152 and the newly read operation time (i.e. the time represented by the adjusted time setting signal generated by the variable resistor 136 when the rotary operation member 122 is rotated), and then, in step S15, the set operation time in the second memory 154 is adjusted in accordance with the value calculated by the processor 156. For example, when the rotary operation member 122 is rotated clockwise (or counter-clockwise) in FIG. 9, then, in step S14, the value ΔT calculated by the processor 156 is positive (or negative). Then, in step S15, this calculated value ΔT is added to (or subtracted from) the remaining time stored in the second memory 154, and the thus newly set remaining time is stored in the second memory 154. This causes the remaining time of the timer 160 to be extended (or shortened). The remaining time is adjusted in this way, and thus the processor 156 serves also as a remaining time adjusting device.

In step S13, whether the value stored in the second memory 154, i.e. the remaining time of the timer 160, is zero or not is checked. If the remaining time is not zero, the operation sequence returns to step S7 to continue counting down the remaining time of the timer 160. When the remaining time becomes zero, the operation sequence proceeds to step S16, where the controller 120 opens the relay switch 174 and thereby deactivates the magnetron 116 and others (step S17). This is the end of the heating that the microwave oven has been performing for the set operation time. On completion of heating, the operator rotates the rotary operation member 122 to the "off" position, and thereby the rotary operation member 122 is returned to its original position.

In this embodiment, the time setting device 108 is provided with a rotary operation member that is operated by being rotated, and sets the operation time in accordance with the angle through which this rotary operation member 122 is operated. However, it is also possible to use a sliding operation member instead of the rotary operation member 122. In that case, the operation time is set in accordance with the distance through which the sliding operation member is slid.

Moreover, in this embodiment, the time signal generator 126 is composed of a variable resistor 136 serving as a potentiometer 138. However, it is also possible to compose the time signal generator of, instead of a variable resistor 136, a rotary switch that generates a signal containing as many pulses as corresponds to the angle through which it is rotated. In that case, the number of pulses that are generated by the rotary switch is used as the time setting signal, and the operation time is set in accordance with the number of those pulses.

Moreover, in this embodiment, all the light-emitting devices 148 employed in the remaining time indicator 128 are of the same type. However, it is also possible to use two types of light-emitting devices so that two types of light-emitting devices that emit light in two different colors are employed for each of the figures, unit time symbols, and time subdivision symbols of the time indication plate 122 and that the type of the light-emitting devices that are turned on is selected in accordance with the power of the heating output of the magnetron 116. In other words, when high-power output is selected, the light-emitting devices of one type are turned on, and, when low-power output is selected, the light-emitting devices of the other type are turned on. For example, in a case where a green light-emitting diode and a red light-emitting diode are used for each of the light-emitting devices, the red light-emitting diodes are turned on when high-power output is selected, and the green light-emitting diodes are turned on when low-power output is selected. This permits the operator to recognize the power of the heating output of the microwave oven with ease by the color of the light emitted by those light-emitting devices.

Furthermore, although this embodiment deals with a microwave oven as an example of an electric appliance, similar embodiments are possible also in other types of electric appliances such as electric clothes washers, electric clothes driers, and dishwashers.

<Second Embodiment>

Figure 1:
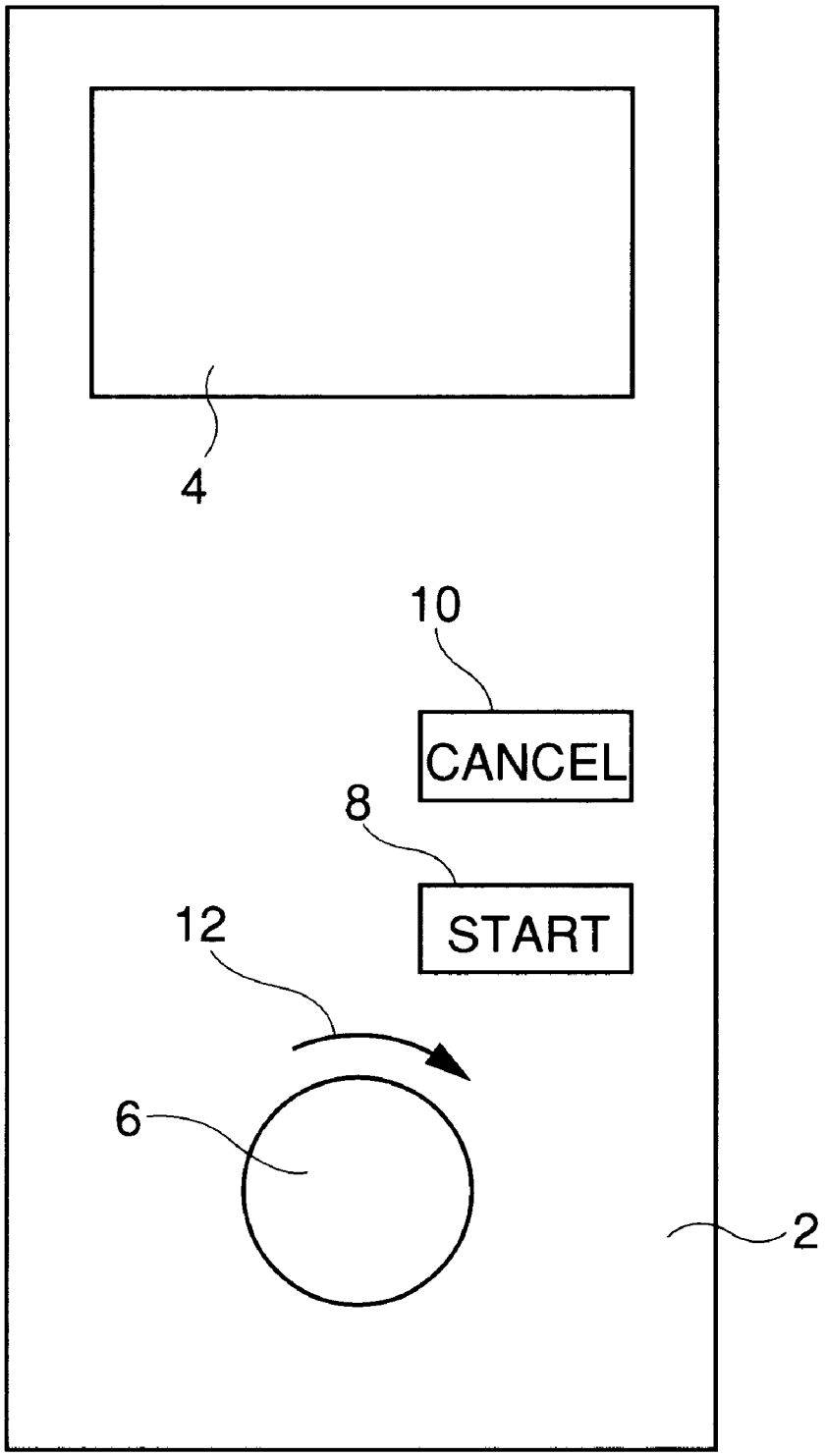
FIG.1 PRIOR ART
FIG. 1 is a front view of the operation panel of a conventional microwave oven.
Figure 2:
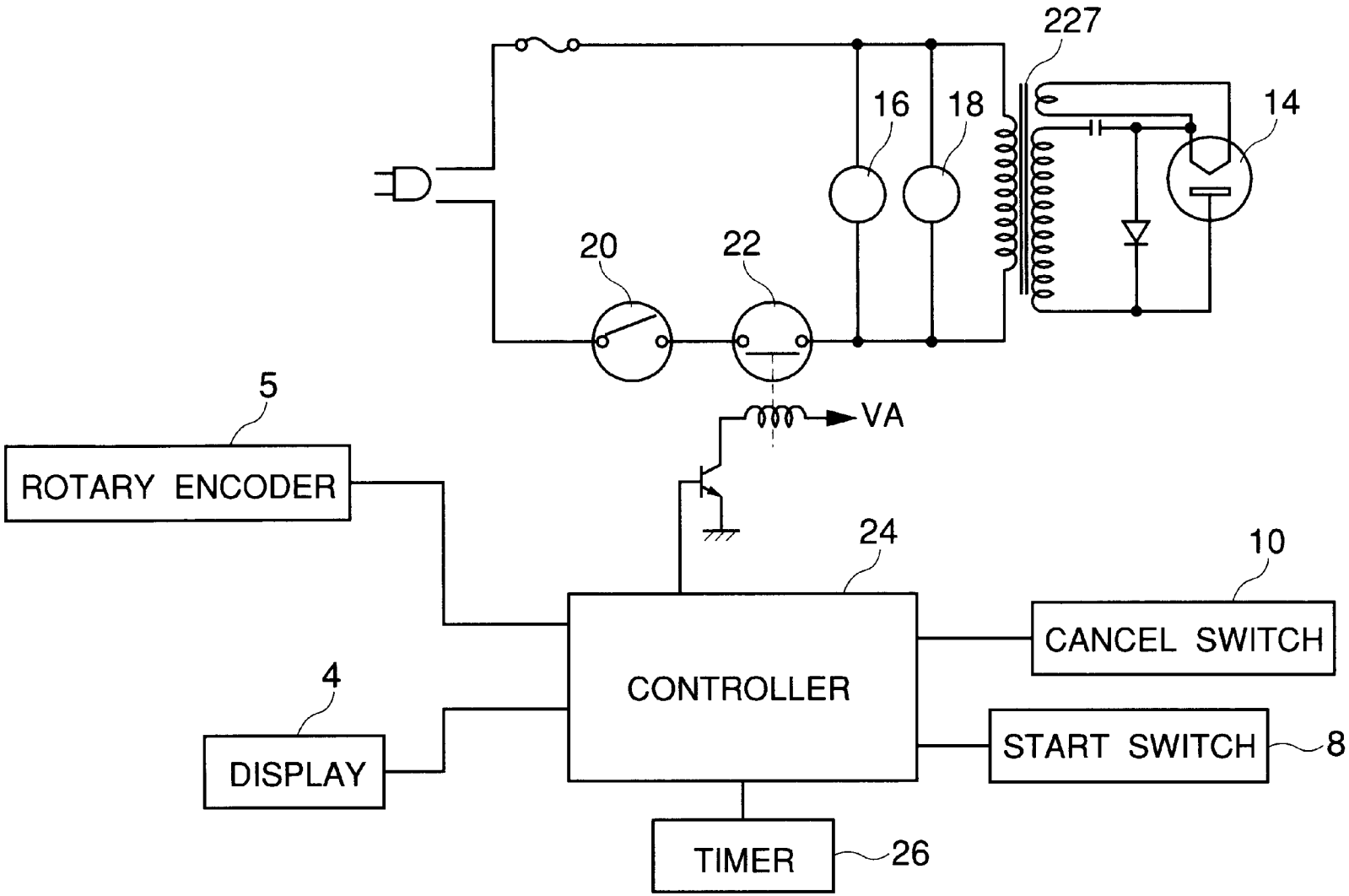
FIG.2 PRIOR ART
FIG. 2 is a block circuit diagram of the control system of the microwave oven shown in FIG. 1.
Figure 3:
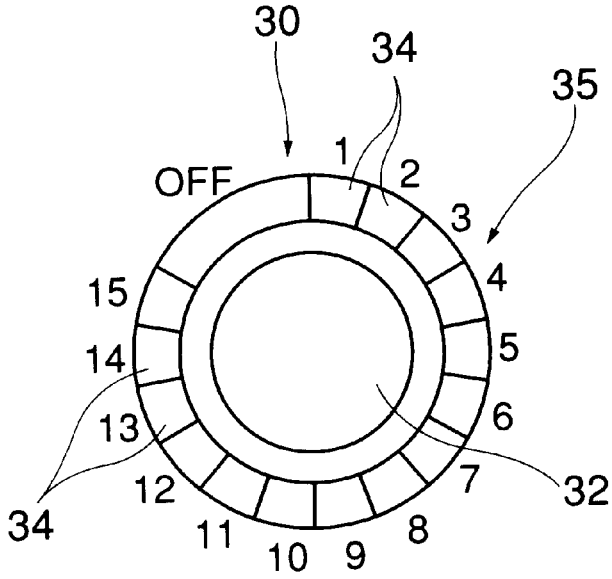
FIG.3 PRIOR ART
FIG. 3 is a front view of the time setting device employed in a conventional electric washer.
Figure 4A:
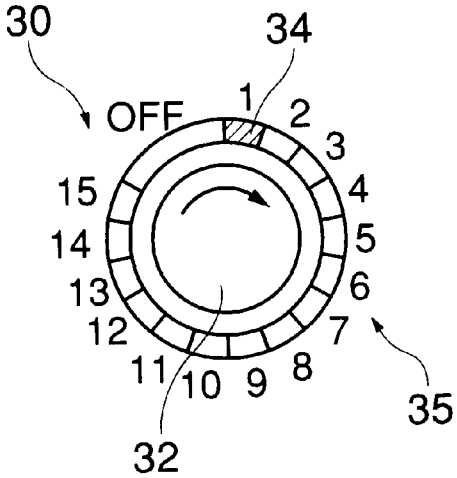
FIG.4A PRIOR ART
FIGS. 4A and 4B are diagrams explaining how the time setting device shown in FIG. 3 is operated.
Figure 4B:
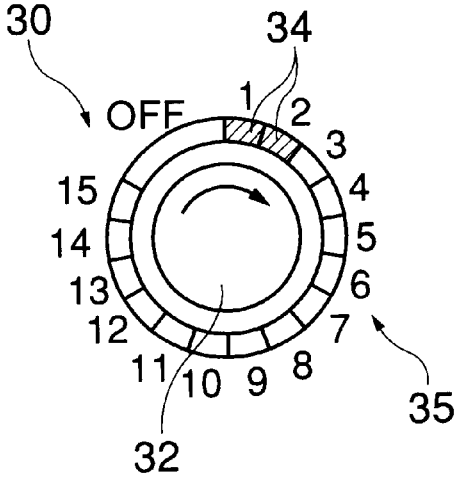
FIG.4B PRIOR ART
Figure 5:
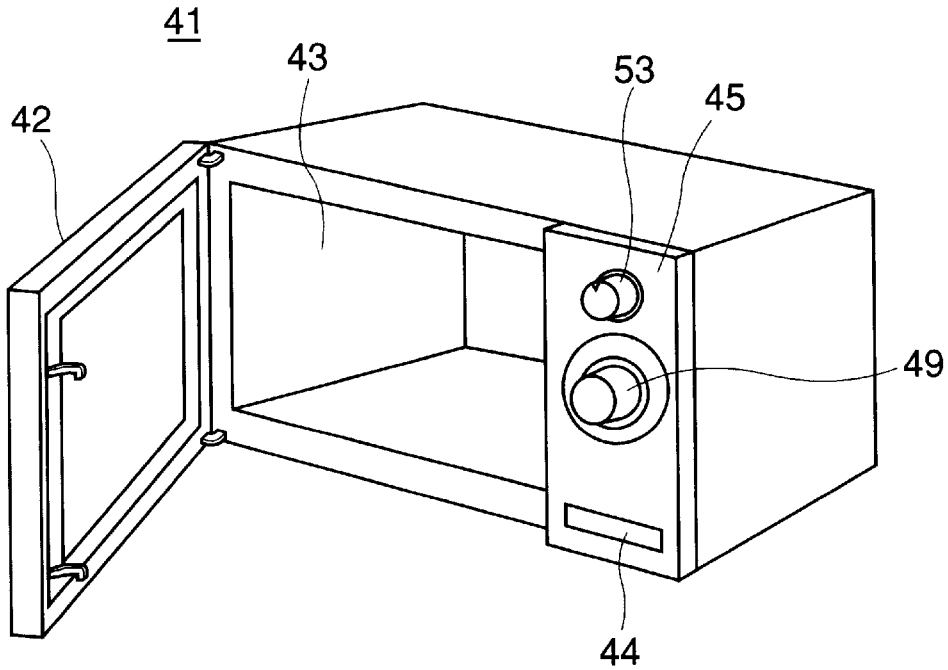
FIG.5 PRIOR ART
FIG. 5 is a perspective view of a budget-priced microwave oven.
Figure 6:
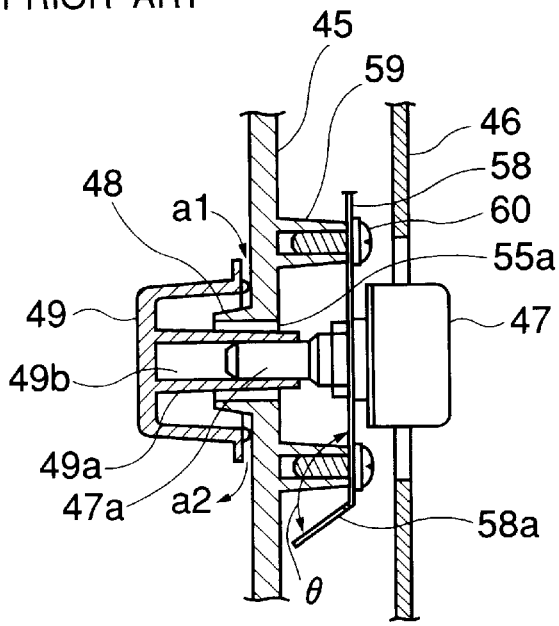
FIG.6 PRIOR ART
FIG. 6 is a sectional view of the operation knob employed in a conventional budget-priced microwave oven.
Figure 13B:
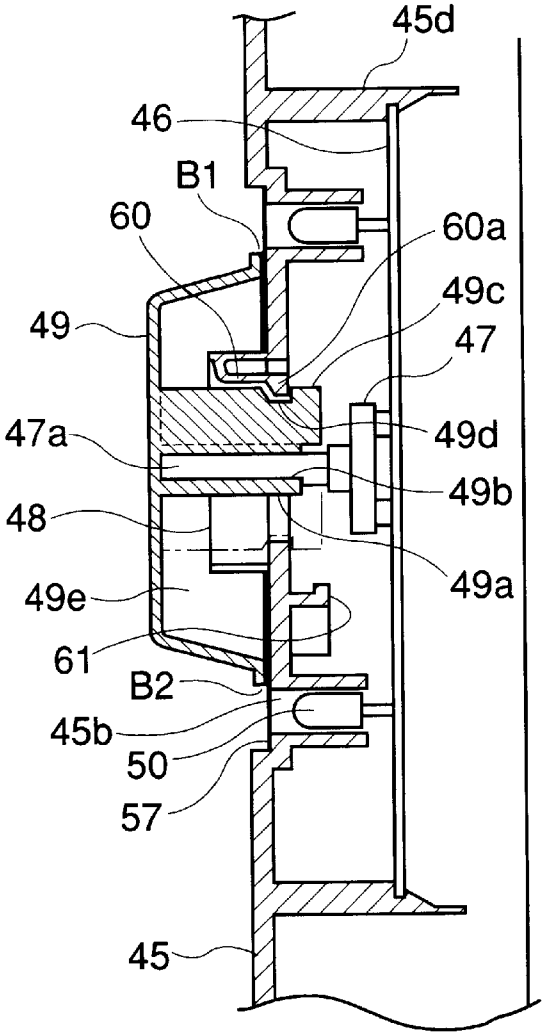
FIG. 13B is a vertical section of the time setting knob shown in FIG. 13A.
Figure 13A:
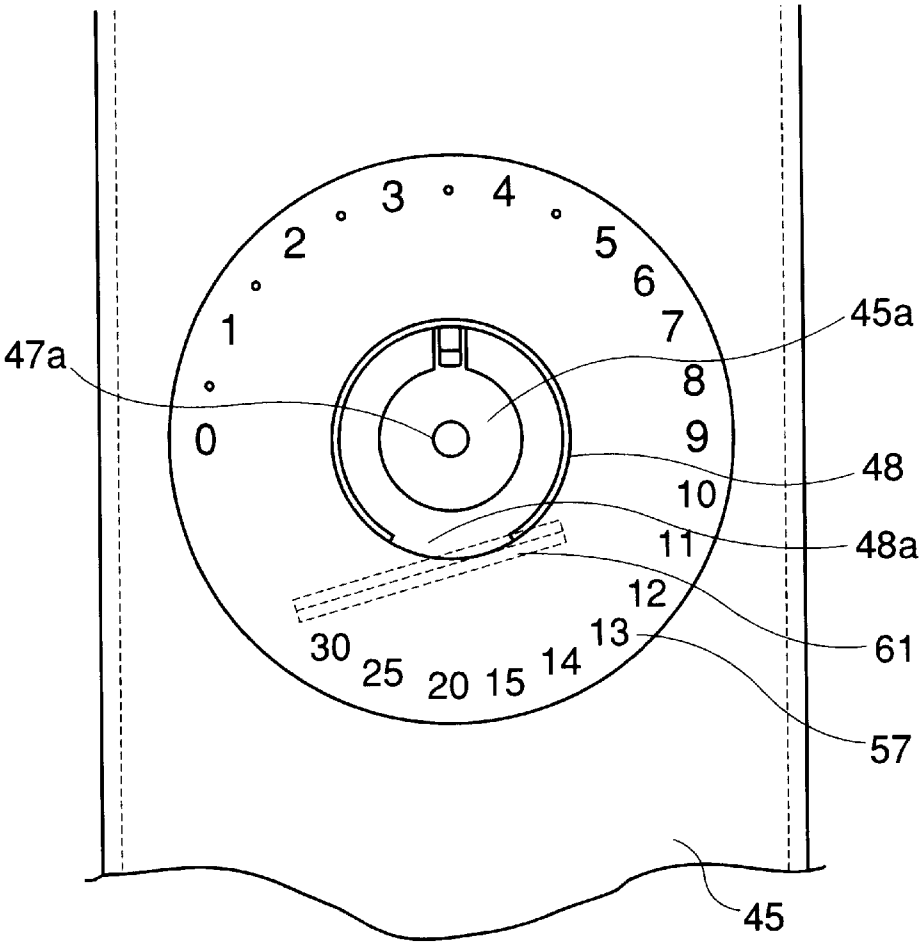
FIG. 13A is a front view of the time setting knob of the microwave oven of a second embodiment of the present invention.
Figure 14:
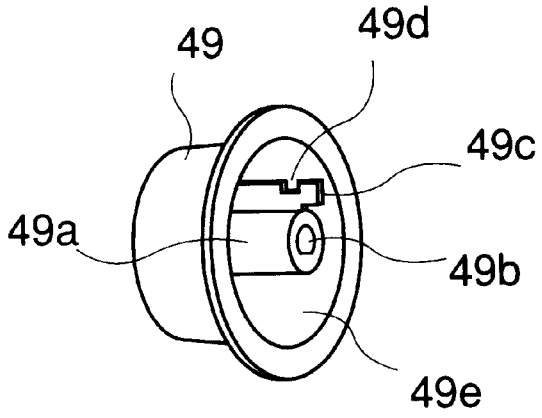
FIG. 14 is a perspective view illustrating the details of the time setting knob shown in FIG. 13A.
Figure 15:
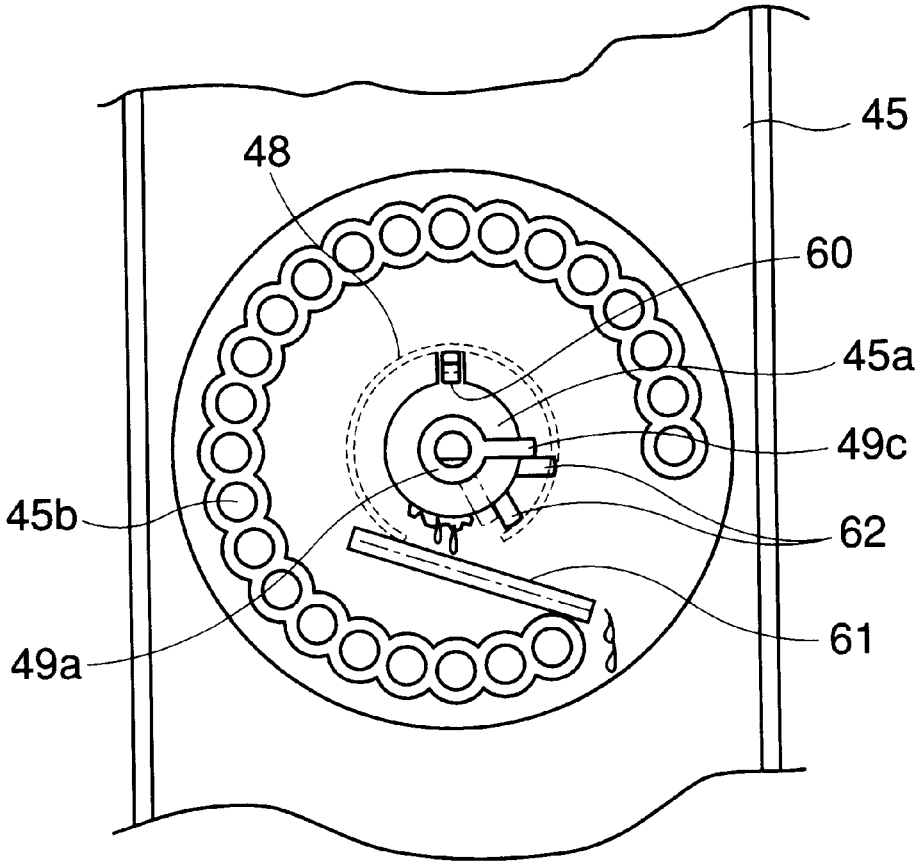
FIG. 15 is a rear view of the time setting knob shown in FIG. 13A, as seen from the back of the operation panel.

Next, with reference to FIGS. 13 to 15, the structure of an electric appliance of a second embodiment of the present invention will be described. Here, another microwave oven is taken up as an example of such an electric appliance. Note that, in these figures, such components as are found also in the conventional example shown in FIGS. 5 and 6 are identified with the same symbols. FIG. 13A is a front view of the time setting knob 49, illustrating its structure and surroundings, and FIG. 13B is a vertical section of the time setting knob 49. FIG. 14 is a perspective view of the time setting knob 49, illustrating its details, and FIG. 15 is a rear view of the time setting knob 49 as seen from the back of the operation panel 45.

The operation panel 45 has a rib 45*d* formed thereon, on which a control board 46 is fixed. On the control board 46, a time setting device 47 such as an encoder and a plurality of light sources 50 are fitted so that the light sources 50 illuminate, through illumination holes 45*b* formed in the operation panel 45, time indications marked on an indication plate 57 that is glued to the front surface of the operation panel 45 and thereby indicate a length of time. The time setting device 47 has a rotary shaft 47*a*, which is, through a through hole 45*a* formed in the operation panel 45, pressed into a boss hole 49*b* formed in a boss 49*a* of the time setting knob 49 in such a way that the time setting knob 49 and the rotary shaft 47*a* rotate together.

The operation panel 45 has a watertight rib 48 formed around the through hole 45*a* so as to project from the operation panel 45. The watertight rib 48 has a cut 48*a* in its lower portion, and is so formed as to be hid inside the concavity 49*e* formed at the back of the time setting knob 49. As a result, in case water drops penetrate inside the time setting knob 49 through the gap B1 between the time setting knob 49 and the operation panel 45 (more precisely, in this embodiment, between the time setting knob 49 and the indication plate 57), they are prevented from penetrating to the back surface of the operation panel 45.

Moreover, a part of the watertight rib 48 is formed into a locking claw 60 having such a structure as to exhibit resilience. At the tip 60*a* of the locking claw 60, the surface facing frontward is formed into a slant surface so that, when the tip 60*a* receives a force acting horizontally from the front side, it deforms upward in the figure, and, when it receives a force acting horizontally from the back side, it does not deform.

As detailedly shown in FIG. 14, the boss 49*a* of the time setting knob 49 has an engagement piece 49*c* that extends outward in the direction of a radius of the boss 49*a*, and the engagement piece 49*c* has a cut 49*d*, which is kept slidably engaged with the periphery of the locking claw 60 and the through hole 4*a* when the time setting knob 49 is rotated.

As shown in FIG. 15, on the back surface of the operation panel 15, a drainage guide 61 is formed integrally with the operation panel 45 for the drainage of water drops. As a result, in case water drops penetrate to the back surface of the operation panel 45, they are made to flow first downward along the operation panel 45 and then along the drainage guide 61 so that they are drained without contacting the control board 46 and the light sources 50. The rotation angle of the time setting knob 49 is limited by the engagement piece 49*c* hitting stoppers 62 formed integrally with the operation panel 45.

In this structure, when the operation panel 45 is cleaned with wet wiping cloth or the like, the water drops that have penetrated inside the time setting knob 49 through the gap B1 between the time setting knob 49 and the operation panel 45 (more precisely, in this embodiment, between the time setting knob 49 and the indication plate 57) are drained by being guided along the outer surface of the watertight rib 48 and then out through the gap B2 on the lower side of the time setting knob 49. On the other hand, the water drops that have penetrated inside the watertight rib 48 are drained by being guided downward along the inner wall of the watertight rib 48 and then out through the cut 48*a*. Thus, it is possible to prevent water drops from being collected inside the watertight rib 48 and thereby prevent the growth of mold.

The drainage guide 61 on the back surface of the operation panel 45 can be formed integrally with the operation panel 45, and therefore it helps reduce the number of components and thus the production cost as compared with the conventional structure in which a watertight plate is fixed with screws (see FIG. 6).

In this embodiment, the locking claw 60 is formed integrally with the watertight rib 48. However, it may be formed separately from the watertight rib 48, or may be so formed as to protrude toward the back side of the operation panel.

<Third Embodiment>

Figure 16A:
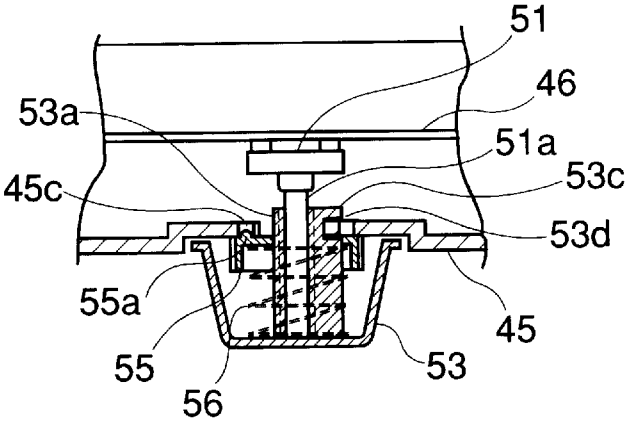
FIG. 16A is a horizontal section of the operation knob of the microwave oven of a third embodiment of the present invention.
Figure 16C:
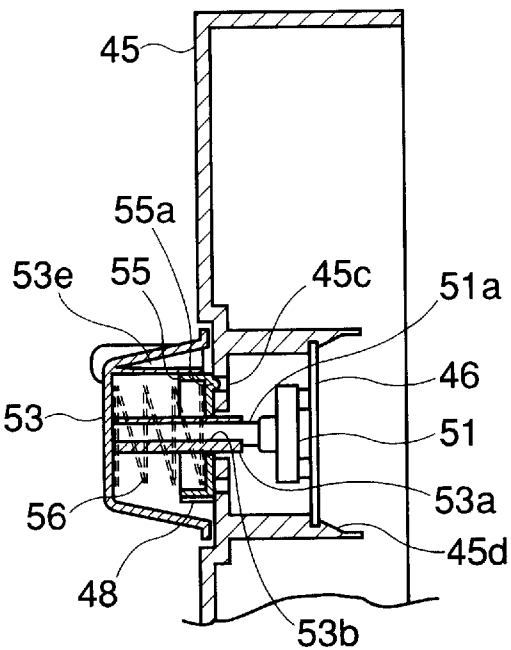
FIG. 16C is a vertical section of the operation knob shown in FIG. 16A.
Figure 16B:
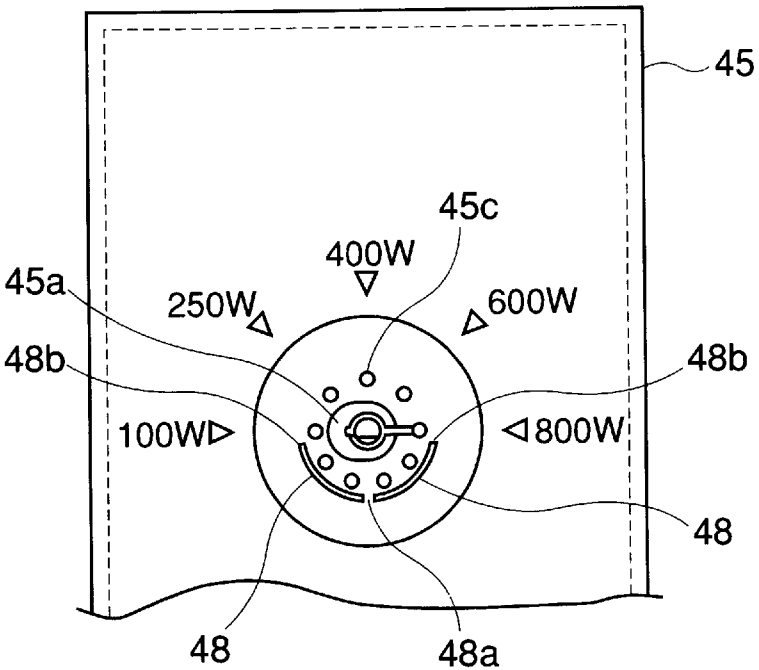
FIG. 16B is a front view of the operation knob shown in FIG. 16A.

Next, with reference to FIG. 16, the structure of an electric appliance of a third embodiment of the present invention will be described. Here, another microwave oven is taken up as an example of such an electric appliance. FIGS. 16A, 16B, and 16C illustrate the structure of an operation knob, as can be applied to the heating power setting knob 53, having a click mechanism that allows the output power to be set in steps, with FIG. 16A showing its horizontal section, FIG. 16B showing its front view, and FIG. 16C showing its vertical section. Note that such components as are found also in the second embodiment are identified with the same symbols.

In the same manner as in the second embodiment, the operation panel 45 has a rib 45*d* formed thereon, on which a control board 46 is fixed. On the control board 46, a heating power setting device 51 is mounted. The heating power setting device 51 has a rotary shaft 51*a*, which is, through a through hole 45*a* formed in the operation panel 45, pressed into a boss hole 53*b* formed in a boss 53*a* of the heating power setting knob 53. The heating power setting knob 53 has an engagement piece 53*c*, which has a cut 53*d* that is kept slidably engaged with the periphery of the through hole 45*a* when the heating power setting knob 53 is rotated together with the rotary shaft 51*a*.

Figure 17:
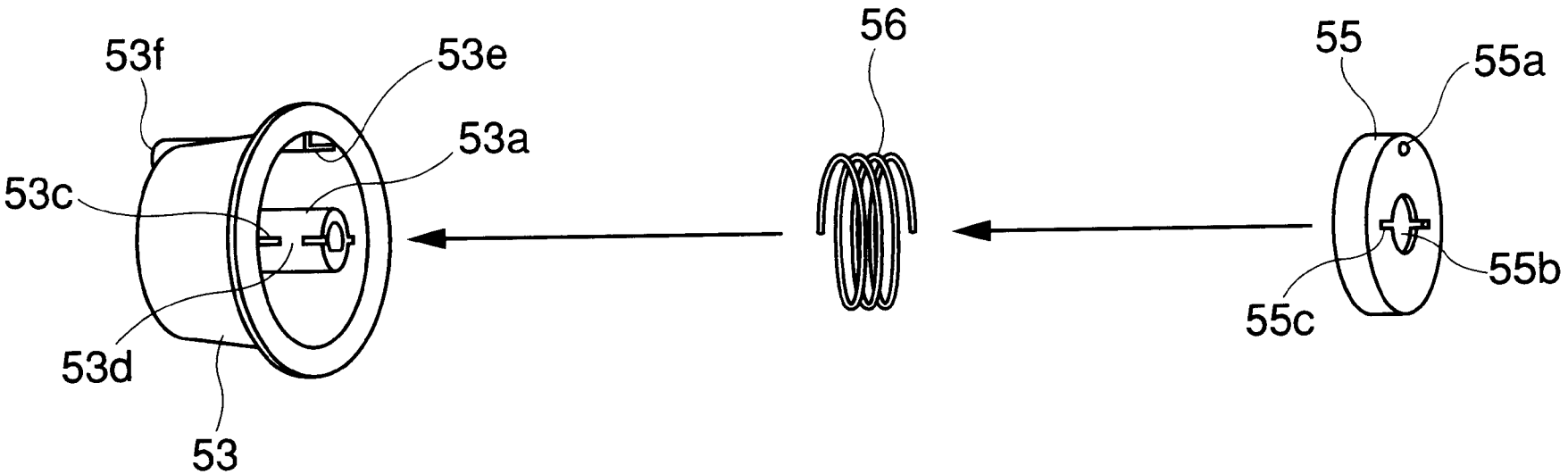
FIG. 17 is a perspective view illustrating how the click plate shown in FIG. 16 is fitted.

Inside the heating power setting knob 53, a click plate 55 is so held that it is pressed against the operation panel 45 by the action of a spring 56. As shown in FIG. 17, in placing the click plate 55 inside the heating power setting knob 53, the boss 53*a* is inserted into a hole 55*b* in such a way that an engagement piece 53*c* projecting from the boss 53*a* engages with a slit 55*c*. As a result, the click plate 55 rotates together with the heating power setting knob 53. A projection 55*a* formed on the click plate 55 and a plurality of dents 45*c* formed on the operation panel 45 constitute a click mechanism.

In this structure, it is possible to realize a click mechanism without using an expensive cooking condition setting device having a click mechanism. In addition, since the click plate 55 is so shaped that, when pressed against the operation panel 45, no gap is left in between, it is possible to reduce the risk of water drops that have penetrated through the gap between the operation panel 45 and the heating power setting knob 53 penetrating further to the back surface of the operation panel and thereby bringing control devices into contact with water.

Figure 18A:
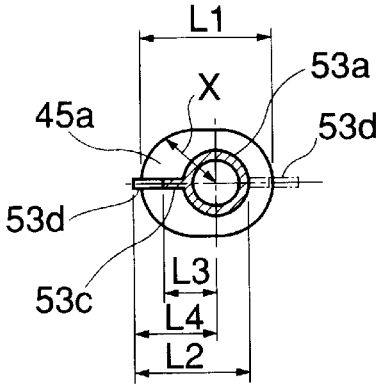
FIGS. 18A, 18B, and 18C are plan views illustrating the shape of the through hole provided in the third embodiment.

Moreover, the through hole 45*a* has an elongated shape such that, as shown in FIG. 18A, its major-axis diameter L1 is greater than the maximum dimension L2 of the boss 53*a*, as measured in its section, of the heating power setting knob 53. The boss 53*a*, after being inserted into the through hole 45*a*, is so positioned that the cut 53*d* slidably engages with the periphery of the through hole 45*a*. At this time, the dimensions of the through hole 45*a* are determined to ensure that the cut 53*d* slidably engages with the periphery of the through hole 45*a* over the entire periphery of the through hole 45*a*, i.e. to ensure that condition ( 1) below is fulfilled in the figure.

$$L3<X<L4. \quad (1)$$

Figure 18B:
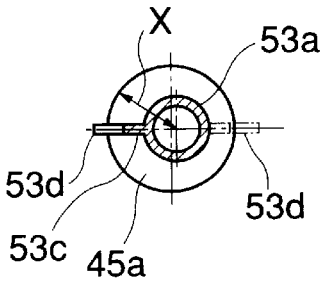
Figure 18C:
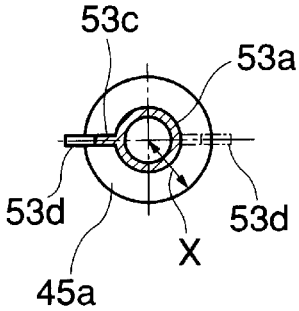

As long as the heating power setting knob 53 has dimensions that fulfill condition (1), once it is placed in position, it cannot be pulled out. This helps prevent risks such as a malfunction. The through hole 45*a* does not necessarily have to be of the shape of an elongated circle: it may be of the shape of a decentered circle as shown in FIG. 18B, that of a concentric circle as shown in FIG. 18C, or any other shape, as long as it is large enough to allow the insertion of the boss 53*a* and fulfills condition (1).

Figure 19A:
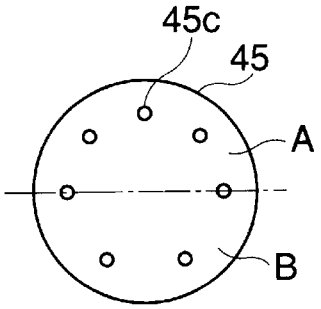
FIGS. 19A, 19B, and 19C are diagrams schematically illustrating the click mechanism employed in the third embodiment.

In FIGS. 16A, 16B, and 16C, the click mechanism is realized by engaging the projection 55*a* formed on the click plate 55 with one of the plurality of dents 45*c* formed on the operation panel 45. As shown in FIG. 19A, when the heating power setting knob 53 is designed to rotate through 180 degrees, it is possible, simply by changing the direction in which the click plate 55 is attached, to selectively use one of two regions A and B that are provided on the operation panel 45 in such a way that each contains a different number of dents 45*c* to be engaged with the projection 55*a* of the click plate 55. Thus, it is possible to select the number of steps (in this example, four or three steps) in which the heating power can be adjusted.

Figure 19B:
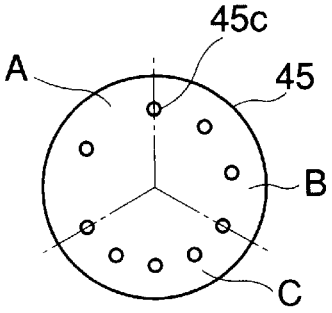
Figure 19C:
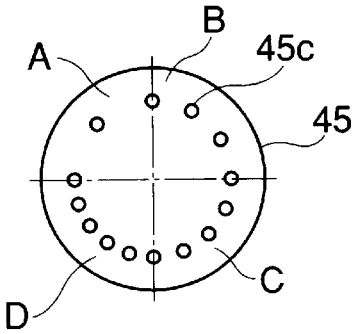

As shown in FIG. 19B, when the heating power setting knob 53 is designed to rotate through 120 degrees, it is possible to selectively use the dents 45*c* of one of three regions A, B, and C and thereby achieve three adjustment steps. As shown in FIG. 19C, when the heating power setting knob 53 is designed to rotate through 90 degrees, it is possible to selectively use the dents 45*c* of one of four regions A, B, C, and D and thereby achieve four adjustment steps.

By forming a different number of dents 55*c* in each of the regions provided in accordance with the number of directions in which the click plate 55 can be attached, it is possible to produce microwave ovens 41 that allow adjustment of the output power in different steps by the use of heating power setting devices of an identical type and thereby reduce production cost. In this embodiment, the click mechanism is realized by providing a projection 55*a* on the click plate 55 and providing dents 45*c* on the operation panel 45. However, it is also possible to obtain the same effects by providing a plurality of dents on the click plate 55 and providing a projection on the operation panel 45.

In FIGS. 16A, 16B, and 16C, the watertight rib 48 has its upper portion, extending through about 180 degrees, cut out and has stopper surfaces 48*b* (serving as a rotation limiting member). The rotation angle of the heating power setting knob 53 is limited by these stopper surfaces 48*b* being hit by a locking portion 53*e* formed on the heating power setting knob 53. This structure is effective in cases where no space can be secured on the back surface of the operation panel 45 to provide the stoppers 62 as shown in FIG. 15.

Figure 20:
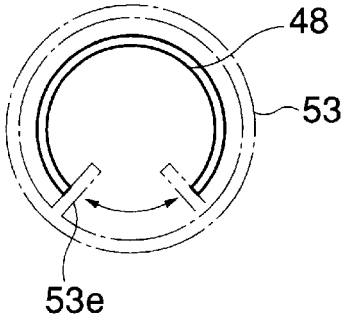
FIG. 20 is a diagram schematically illustrating the heating power setting knob having a cut for drainage employed in the third embodiment.

It is also possible to limit the rotation of the heating power setting knob 53 by forming the upper portion of the watertight rib 48 into a rib having a smaller height, or by providing the projection on the outer surface or at the peak of the watertight rib 48. This helps prevent the water drops that have penetrated through the upper opening from penetrating inside the watertight rib 48. As shown in FIG. 20, in cases where the heating power setting knob 53 is designed to rotate through a relatively small angle, the cut 48*a* for drainage formed in the heating power setting knob 53 can be used also as a rotation limiting member. This also helps prevent the water drops that have penetrated through the upper part of the heating power setting knob 53 from penetrating inside the watertight rib 48.

<Fourth Embodiment>

Figure 21:
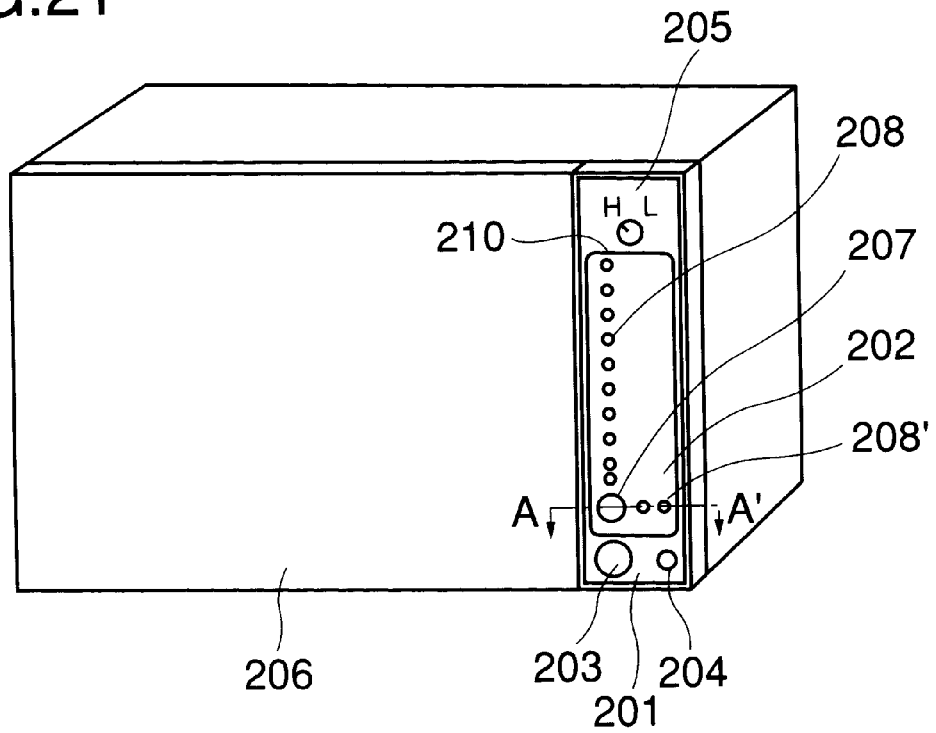
FIG. 21 is a perspective view showing the appearance of the microwave oven of a fourth embodiment of the present invention.

Next, with reference to FIG. 21, the structure of an electric appliance of a fourth embodiment of the present invention will be described. Here, another microwave oven is taken up as an example of such an electric appliance. FIG. 21 shows the appearance of the microwave oven of this embodiment. It has an operation panel 201 in the right-hand portion of its front surface. On the operation panel 201 is provided a time setting device 202 for setting the heating time. Below the time setting device 202 are provided a start button 203 for starting microwave heating and a cancel button 204 for canceling the previously set heating time and stopping microwave heating. Above the time setting device 202 is provided an output power setting knob 205 for switching the output power of microwave heating between "high" and "low". In the figure, numeral 206 represents a door for opening and closing the front-side opening of a heating chamber.

Figure 22:
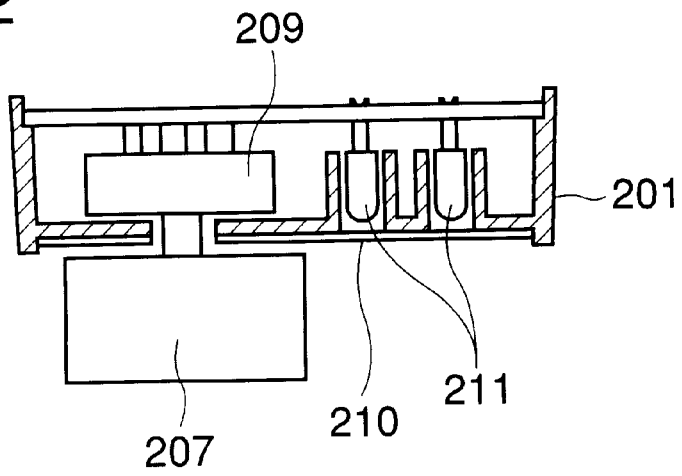
FIG. 22 is a sectional view taken along line A—A' in FIG. 21.

In terms of its appearance, the time setting device 202 is composed of a rotary knob 207, and a plurality of dot indicators 208 and 208' for indicating the operation time. As shown in FIG. 22, which is a sectional view taken along line A–A' of FIG. 21, the rotary knob 207 is fitted onto a rotary shaft of a rotary encoder 209. The dot indicators 208 and 208' are composed of an indication sheet 210 on which various settable lengths of time are marked in a strip-like area, light-emitting diodes 211 that correspond to the indicators 208 and 208, and light-emitting diodes 211' that correspond to the indicators 208' and 208', with all these light-emitting diodes placed behind the indication sheet 210.

Figure 23:
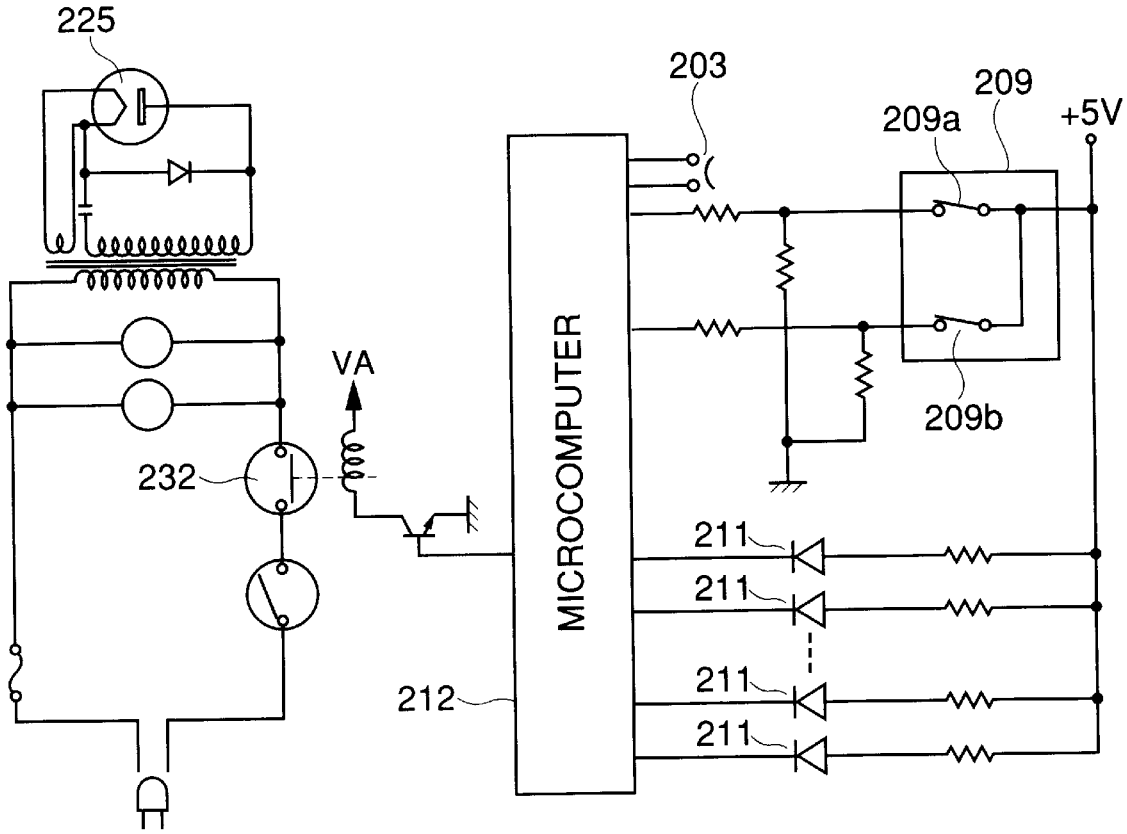
FIG. 23 is a circuit diagram of the microwave oven of the fourth embodiment.
Figure 24:
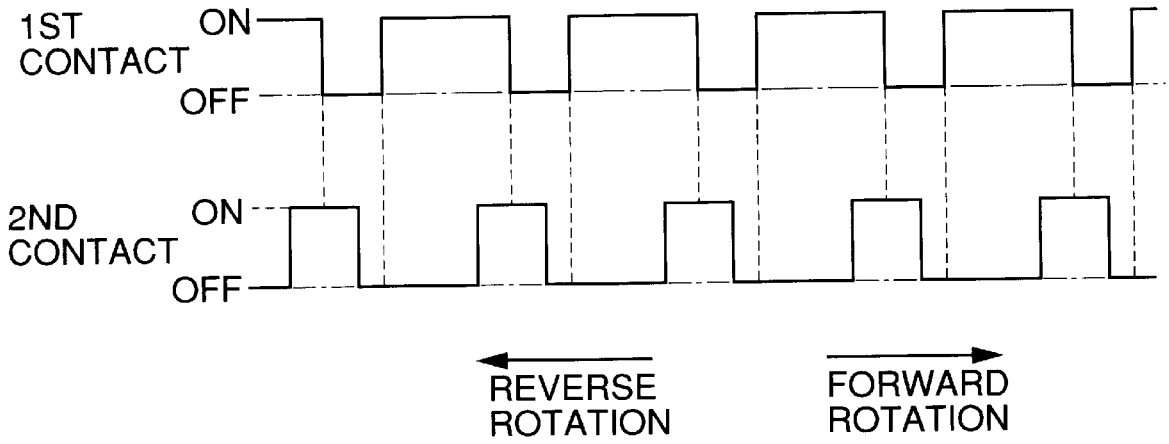
FIG. 24 is a diagram showing the waveform of the signals appearing at the two contacts of the rotary encoder.

As shown in FIG. 23, the rotary encoder 209 incorporates two switching contacts 209*a* and 209*b* (hereafter referred to as the first and second contacts. respectively), of which each is repeatedly turned on and off every predetermined rotation angle as the rotary knob 207 is rotated. The contacts 209*a* and 209*b* each have one end connected to a +5V power source terminal, and have the other end connected through a resistor to ground and also through another resistor to a microcomputer 212 serving as a controller. Here, as shown in FIG. 24, as the rotary knob 207 is rotated, the contacts 209*a* and 209*b* are turned on and off in different manners so that the microcomputer 212 can recognize the rotation direction of the rotary knob 207.

For example, if the second contact 209*b* is on when the first contact 209*a* shifts from on to off, the rotary knob 207 is found to be rotating in the forward direction; if the second contact 209*b* is off when the first contact 209*a* shifts from on to off, the rotary knob 207 is found to be rotating in the reverse direction. In addition, the microcomputer 212 calculates how many times either of the contacts 209*a* and 209*b* is turned on and off and thereby detects the angle through which the rotary knob 207 is rotated. In accordance with this angle through which the rotary knob 207 is rotated, that is, in accordance with how many times the contacts are turned on and off, the operation time (in minutes) is set.

Figure 25:
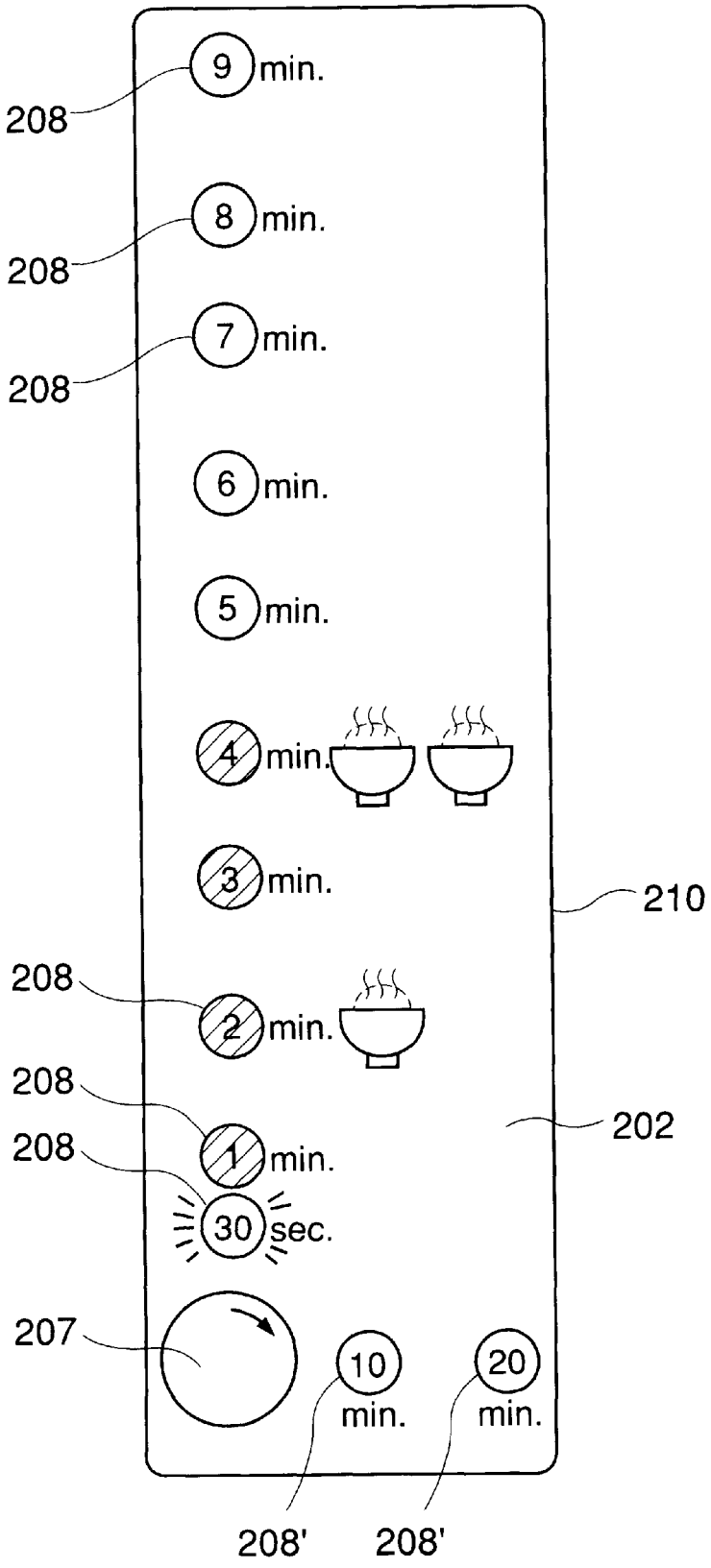
FIG. 25 is a diagram illustrating the time setting device of the fourth embodiment.

In addition, as shown in FIG. 25, the indication sheet 210 of the operation panel 201 has dot indicators 208 composed of ten light-emitting diodes 211 arranged in a vertical line above the rotary knob 207. These dot indicators 208 are turned on or blinked to indicate various lengths of time from 30 seconds to 9 minutes. The dot indicators 208 are arranged upward, starting with the one indicating the shortest time and ending with the one indicating the longest time, at intervals that are proportional to the lengths of time that are indicated. Each indicator 208 is marked with the length of time it indicates, together with the unit of time. Accordingly, the total length (height) of the indicators 208 that are turned on is proportional to the length of time that is set in accordance with the angle through which the rotary knob 207 is rotated.

As shown in FIG. 23, the light-emitting diodes 211 constituting the indicators 208 have their anode connected through a current limiting resistor to the +5V power source terminal, and have their cathode connected to the microcomputer 212 so that their turning-on and -off is controlled by the microcomputer 212. Accordingly, in accordance with the signals from the two contacts 209*a* and 209*b* of the rotary encoder 209, the microcomputer 212 calculates the angle through which the rotary knob 207 is rotated, sets the operation time that corresponds to the thus calculated angle in the timer integrated in the microcomputer 212, and turns on that one of the light-emitting diodes 211 which corresponds to the thus set operation time and all the light-emitting diodes that are located oil the shorter-time side of that light-emitting diode.

In this way, the microcomputer 212 controls the turning-on and -off of the light-emitting diodes 211 by detecting the rotation direction and angle of the rotary knob 207. As a result, as shown in FIG. 25, as the rotary knob 207 is rotated clockwise, the operation time is set at one value after another in increasing order starting with the shortest time (30 seconds) in accordance with the angle through which the rotary knob 207 is rotated, and meanwhile one indicator after another is turned on starting with the one indicating the shortest time ( 30 seconds). A predetermined time after the halt of the rotation of the rotary knob 207, the thus specified heating time is definitely set. Thereafter, when the rotary 207 is rotated clockwise, the indicator indicating additional 30 seconds starts blinking, and 30 seconds are added to the set operation time: as the rotary knob 207 is rotated further clockwise, one minute, two minutes, three minutes, . . . are added to the set operation time, and then the thus far blinking 30-second indicator is solidly turned on and the indicators corresponding to the added time are turned on in due order. By contrast, as the rotary knob 207 is rotated counter-clockwise, the indicator indicating 30 seconds to be subtracted starts blinking, and 30 seconds are subtracted from the set operation time; as the rotary knob 207 is rotated further counter-clockwise, one minute, two minutes, three minutes, . . . are subtracted from the set operation time, and then the thus far blinking 30-second indicator is solidly turned on and the indicators corresponding to the subtracted time that are on the longer-time side of the currently set time is turned off in due order.

FIG. 25 shows an example of the display as seen when, after the operation time is once set at 4 b minutes,the rotary knob 207 is rotated clockwise to add 30 seconds thereto so that the operation time is eventually set at 4 minutes 30 seconds. Here, the indicators indicating 1 minutes to 4 minutes are turned on, and in addition the indicator for the added 30 seconds is turned on. The operation time can be set at 4 minutes 30 seconds also by first setting it to 5 minutes and then rotating the rotary knob 207 counter-clockwise to subtract 30 seconds therefrom. In that case, after the indicators indicating 30 seconds to 5 minutes are once turned on, the indicator indicating 5 minutes is turned off, and the indicator for the subtracted 30 seconds is made to start blinking.

On the right of the rotary knob 207, dot indicators 208' and 208' composed of two light-emitting diodes 211' are arranged in a horizontal row. When an operation time longer than 10 minutes is set, these indicators, indicating 10 minutes and 20 minutes respectively, are used in combination with the indicators for 30 seconds to 9 minutes to indicate the set operation time. For example, in the example of the indication shown in FIG. 25, if the indicator indicating 10 minutes is additionally turned on, it means that the operation time is set at 14 minutes 30 seconds. Thus, with the time setting device shown in FIG. 25, it is possible to set the operation time at 29 minutes 30 seconds at the maximum.

When the operation time is set at zero, that is, when heating is complete, or when the once set operation time is canceled at the press of the cancel button 204, or when overrotation has caused the operation time to be set at zero, by rotating the rotary knob 207 counter-clockwise, the operation time is set at one value after another in decreasing order starting with the longest time in accordance with the angle through which the rotary knob 207 is rotated, and meanwhile, after all the indicators 208 are once turned on, one indicator after another is turned off starting with the one indicating the longest time.

Accordingly, the operation time can be set at, for example, 24 minutes 30 seconds by first rotating the rotary knob 207 counter-clockwise to turn off the indicators indicating 9, 8, 7, and 6 minutes so that the operating time is once set at 25 minutes, and then rotating the rotary knob 207 further counter-clockwise to make the indicator for the 30 seconds to be subtracted start blinking.

Thereafter, when the microcomputer 212 recognizes the halt of the rotation of the rotary knob 207, the specified time is set in the tinier, and, when the start button 203 is pressed, the microcomputer 212 controls the relay switch 232 to drive the magnetron 225, and simultaneously displays the time recognized by the timer integrated in the microcomputer 212 as remaining by the use of the indicators 208 and 208'. In this embodiment, the operation panel 201 extends vertically, and accordingly the rotary knob 207 and the dot indicators 208 are arranged in a vertical line; however, in cases where the operation panel extends horizontally, they may of course be arranged in a horizontal row.

<Fifth Embodiment>

Figure 26A:
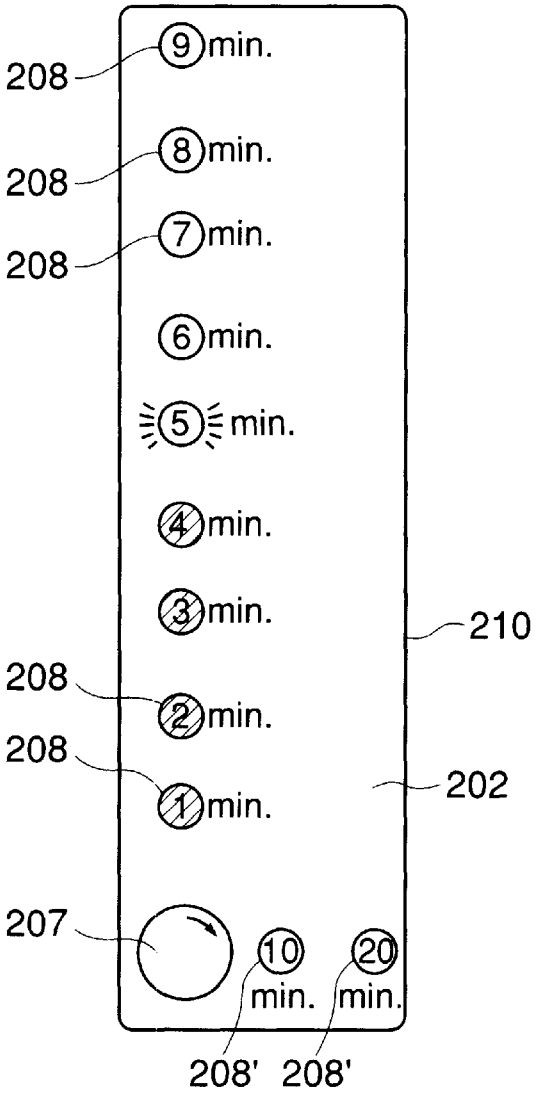
FIGS. 26A and 26B are diagrams illustrating the time setting device of a fifth embodiment of the present invention.
Figure 26B:
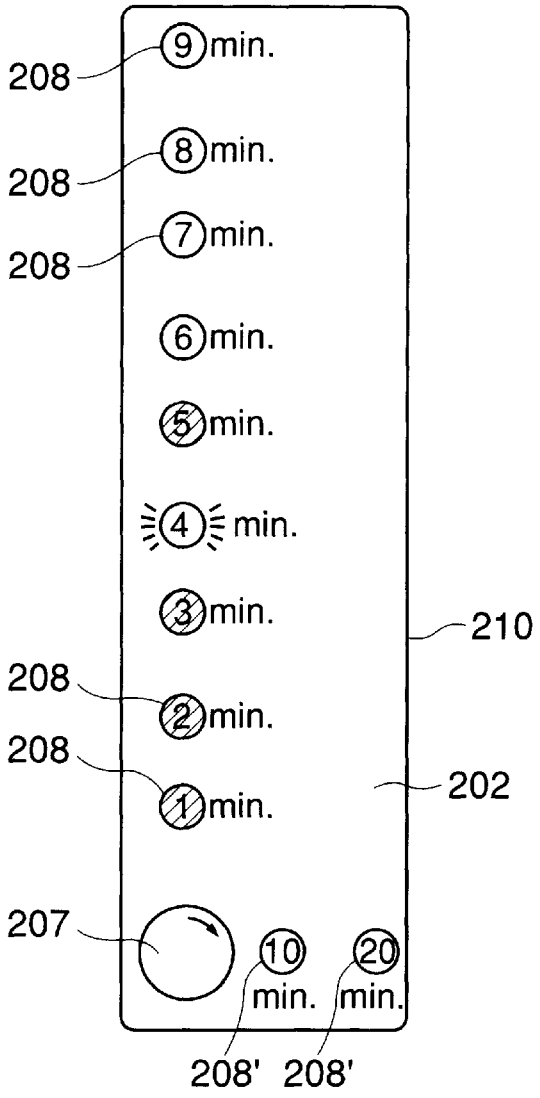

Next, with reference to FIGS. 26A and 26B, the structure of an electric appliance of a fifth embodiment of the present invention will be described. Here, another microwave oven is taken up as an example of such an electric appliance. The fifth embodiment differs from the fourth embodiment only in the hardware structure of the time setting device. Specifically, in this embodiment, the dot indicators used to indicate evenly subdivided times (including extra 30 seconds) between two operation times that can be indicated by two adjacent dot indicators are omitted, and thereby production cost is reduced. Referring to FIGS. 26A and 26B, how the operation time of 4 minutes 30 seconds is indicated by the time setting device of the fourth embodiment.

FIG. 26A shows an example of the indication as seen when the operation time is set at 4 minutes 30 seconds by first rotating the rotary knob 207 clockwise to turn on the indicators indicating 1 to 4 minutes in due order so that the operation time is set at 4 minutes and then rotating the rotary knob 207 further clockwise to make the indicator indicating 5 minutes blink so that 30 seconds are added to the operation time. That is, the indicators indicating 4 and less minutes are turned on to indicate that the operation time is set at at least 4 minutes, and the indicator indicating 5 minutes, which is located above the indicator indicating 4 minutes, is made to blink to indicate that 30 seconds should be added thereto.

FIG. 26B shows another example of the indication as seen when the operation time is set at 4 minutes 30 seconds by first rotating the rotary knob 207 clockwise to turn on the indicators indicating 1 to 4 minutes in due order so that the operation time is set at 4 minutes and then rotating the rotary knob 207 further clockwise to make the indicator indicating 4 minutes blink and to turn on the indicator indicating 5 minutes so that 30 seconds are added to the operation time.

That is, the indicator indicating 5 minutes is turned on to indicate that the operation time is set at not more than 5 minutes, and the indicator indicating 4 minutes, which is located below the indicator indicating 5 minutes, is made to blink to indicate that 30 seconds should be subtracted therefrom.

To indicate that the operation time is set at 4 minutes 30 seconds, which is halfway between 4 minutes and 5 minutes, it is also possible to make the indicators indicating 4 and 5 minutes simultaneously or alternately. In all of the embodiments described heretofore, all the indicators that are located on the shorter-time side of the indicator corresponding to the set operation time are turned on; however, those indicators on the shorter-time side do not necessarily have to be all turned on.

Obviously, many modifications and variations of the present invention are possible in light of the above teachings. It is therefore to be understood that within the scope of the appended claims, the invention may be practiced other than as specifically described.

What is claimed is:

1. An electric appliance comprising:

an electric appliance proper;

an operation member that is operated by being rotated and an angle of rotation of the operation member is correlated with a length of time;

setting means for setting the operation time of said electric appliance proper in accordance with the angle of rotation of said operation member;

timer means that starts counting time in response to a predetermined signal to calculate the remaining time for which said electric appliance proper is still to continue operating;

control means for controlling the operation of said electric appliance proper so that said electric appliance proper continues operating until said remaining times runs out;

adjustment means that, when said operation member is operated while said timer means is counting time, adjusts said remaining time to determine adjusted remaining time in accordance with the angle through which said operation member is rotated; and display means having a plurality of figures marked around said operation member to indicate various lengths of time corresponding to various angles of rotation of said operation member, and having an illumination member for illuminating those figures individually, said display means displaying said remaining time which includes said adjusted remaining time by illuminating a specific one of said figures which corresponds to said remaining time.

2. An electric appliance as claimed in claim 1, wherein said display means further has subdivision symbols for displaying said remaining time including said adjusted time in units smaller than the units in which said remaining time is indicated by said figures, and has an illumination member for illuminating those subdivision symbols individually, said display means displaying said remaining time by additionally illuminating appropriate one or ones of said subdivision symbols.

3. An electric appliance as claimed in claim 2, wherein said display means illuminates said figures and said subdivision symbols intermittently.

4. An electric appliance as claimed in claim 3, wherein said display means is capable of varying the intervals at which it illuminates said figures and said subdivision symbols intermittently.

5. An electric appliance as claimed in claim 1, wherein said display means has a surface coated with fluorescent paint.

6. An electric appliance as claimed in claim 1, wherein said electric appliance is a microwave oven for heating and thereby cooking food, and how said display means illuminates said figures and said subdivision symbols varies with the power with which said microwave oven heats the food.

7. An electric appliance comprising:

a vertically fitted panel having a through hole and a tubular rib formed around the through hole so as to protrude forward;

an operation member fitted on the back side of said panel and having an operation shaft that protrudes forward; and an operation knob having a joint at its back so as to be joined to said operation shaft through said through hole and having such a shape as to cover a part of a surface of said panel on which said rib is formed, wherein said rib has a cut formed in its lower portion.

8. An electric appliance as claimed in claim 7.

wherein said rib has a rotation regulating portion that engages with a locking portion formed at the back of said operation knob so as to regulate rotation angle of said operation knob.

9. An electric appliance comprising:

a panel having a through hole;

an operation member fitted on the back side of said panel and having an operation shaft that protrudes toward the front side of said panel; and an operation knob having a joint at its back so as to be joined to said operation shaft through said through hole and having such a shape as to cover a part of a surface of said panel, wherein said electric appliance further comprises:

a click plate placed between said operation knob and said panel so as to rotate integrally with said operation knob; and a spring placed between an inner wall of said operation knob and said click plate so as to be hid inside said operation knob, wherein said click plate is pressed against said panel by a pressing force of said spring in such a way that, every time said operation knob is rotated through a predetermined angle, a plurality of dents formed on one of a front surface of said panel and a back surface of said click plate engage with a plurality of projections formed on the other.

10. An electric appliance as claimed in claim 9, wherein said click plate can be fitted to said operation knob in a plurality of positions and a different number of dents are formed for an area that corresponds to each of the positions in which said click plate can be fitted.

11. An electric appliance comprising:

a timer for measuring time;

a control means for ending operation of said electric appliance when the time measured by said timer reaches a variable predetermined time;

a rotary operation member that is operated by being rotated;

a setting means for setting said predetermined time in accordance with an angle through which said rotary operation member is operated; and a display means having a plurality of dot indicators for indicating said predetermined time by turning on some of said dot indicators and turning off the others, wherein said rotary operation member and said plurality of dot indicators are arranged in a straight line.

12. An electric appliance as claimed in clam 11, wherein said dot indicators are arranged at intervals that are proportional to lengths of time that can be set.

13. An electric appliance comprising:

a timer for measuring time;

a control means for ending operation of said electric appliance when the time measured by said timer reaches a variable predetermined time;

a rotary operation member that is operated by being rotated;

a setting means for setting said predetermined time in accordance with an angle through which said rotary operation member is operated; and a display means, for displaying said predetermined time, having a plurality of dot indicators and having, between two adjacent ones of said dot indicators, a number of subdivided-time dot indicators, said number being equal to n−1, where n represents a number of parts into which a period between time points corresponding to said two adjacent ones of said dot indicators is subdivided, wherein, when said predetermined time includes a subdivided time, said display means display said predetermined time by turning on those ones of said dot indicators which are on a shorter-time side of said predetermined time and blinking those ones of said subdivided-time dot indicators which correspond to said subdivided time.

14. An electric appliance comprising:

a timer for measuring time;

a control means for ending operation of said electric appliance when the time measured by said timer reaches a variable predetermined time;

a rotary operation member that is operated by being rotated;

a setting means for setting said predetermined time in accordance with an angle through which said rotary operation member is operated; and a display means, for displaying said predetermined time, having a plurality of dot indicates and in addition capable of indicating a subdivided time between times indicated by two adjacent ones of said dot indicators, wherein, when said predetermined time includes a subdivided time, said display means displays said predetermined time by turning on one of said adjacent dot indicators and blinking the other.

15. An electric appliance comprising:

a timer for measuring time;

a control means for ending operation of said electric appliance when the time measured by said timer reaches a variable predetermined time;

a rotary operation member that is operated by being rotated;

a setting means for setting said predetermined time in accordance with an angle through which said rotary operation member is operated; and a display means, for displaying said predetermined time, having a plurality of dot indicators and in addition capable of indicating a subdivided time between times indicated by two adjacent ones of said dot indicators, wherein, when said predetermined time includes a subdivide time, said display means displays said predetermined time by turning on both of said adjacent dot indicators.

* * * * *